US012121100B2

(12) United States Patent
Elder et al.

(10) Patent No.: US 12,121,100 B2
(45) Date of Patent: Oct. 22, 2024

(54) FOOTWEAR WITH FLUID-FILLED BLADDER

(71) Applicant: NIKE, Inc., Beaverton, OR (US)

(72) Inventors: Zachary M. Elder, Portland, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/169,257

(22) Filed: Feb. 15, 2023

(65) Prior Publication Data

US 2023/0189927 A1 Jun. 22, 2023

Related U.S. Application Data

(62) Division of application No. 17/207,322, filed on Mar. 19, 2021, now Pat. No. 11,622,603.

(60) Provisional application No. 63/030,344, filed on May 27, 2020.

(51) Int. Cl.

| | |
|---|---|
| ***A43B 13/20*** | (2006.01) |
| ***A43B 13/02*** | (2022.01) |
| ***A43B 13/18*** | (2006.01) |

(52) U.S. Cl.

CPC ..... *A43B 13/20* (2013.01); *A43B 13/023* (2013.01); *A43B 13/186* (2013.01); *A43B 13/206* (2013.01)

(58) Field of Classification Search

CPC ..... A43B 13/20; A43B 13/206; A43B 13/023; A43B 13/186; A43B 13/122; A43B 23/088

USPC ..... 36/29

See application file for complete search history.

(56) References Cited

U.S. PATENT DOCUMENTS

| | | | | |
|---|---|---|---|---|
| 3,300,880 | A | 1/1967 | Campagna | |
| 4,063,371 | A | 12/1977 | Batra | |
| 4,897,936 | A | 2/1990 | Fuerst | |
| 11,058,174 | B2 * | 7/2021 | Hale | A43B 13/04 |
| 2002/0139471 | A1 * | 10/2002 | Tawney | B29D 22/02 156/205 |
| 2005/0132610 | A1 * | 6/2005 | Foxen | A43B 13/20 36/29 |
| 2012/0174432 | A1 * | 7/2012 | Peyton | A43B 13/188 36/31 |
| 2014/0331517 | A1 | 11/2014 | Seo | |
| 2017/0095033 | A1 * | 4/2017 | Farina | A43B 7/18 |
| 2018/0338577 | A1 * | 11/2018 | Elder | A43B 13/206 |
| 2018/0338578 | A1 * | 11/2018 | Elder | B32B 27/08 |
| 2019/0200700 | A1 * | 7/2019 | Hale | A43B 13/127 |
| 2020/0154825 | A1 * | 5/2020 | Case | A43B 21/28 |

(Continued)

*Primary Examiner* — Khoa D Huynh
*Assistant Examiner* — Haley A Smith
(74) *Attorney, Agent, or Firm* — Quinn IP Law

(57) ABSTRACT

An article of footwear has a sole structure that includes a bladder having stacked polymeric sheet secured to one another at a peripheral bond and defining a first sealed chamber between the first and second polymeric sheets, a second sealed chamber between the second and third polymeric sheets, and a third sealed chamber between the third and fourth polymeric sheets, each of the first, second, and third sealed chambers retaining fluid in isolation from one another. Different patterns of bonds secure adjacent ones of the polymeric sheets to one another, resulting in different geometries of the sealed chambers. The sealed chambers are configured (e.g., by pressure, shape, position, and/or size) to elastically deform to provide a desirable cushioning experience.

17 Claims, 18 Drawing Sheets

(56) References Cited

U.S. PATENT DOCUMENTS

2020/0375308 A1* 12/2020 Langvin ..... A43B 13/16

* cited by examiner

FOOTWEAR WITH FLUID-FILLED BLADDER

CROSS-REFERENCE TO RELATED APPLICATIONS

This application is a divisional of U.S. Nonprovisional application Ser. No. 17/207,322, filed Mar. 19, 2021, which claims the benefit of priority to U.S. Provisional Application No. 63/030,344, filed May 27, 2020 and both of which are incorporated by reference in their entirety.

TECHNICAL FIELD

The present disclosure generally relates to an article of footwear that has a sole structure with a fluid-filled bladder.

BACKGROUND

An article of footwear typically includes a sole structure configured to be located under a wearer's foot to space the foot away from the ground. Sole structures in athletic footwear are typically configured to provide cushioning, motion control, and/or resilience.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
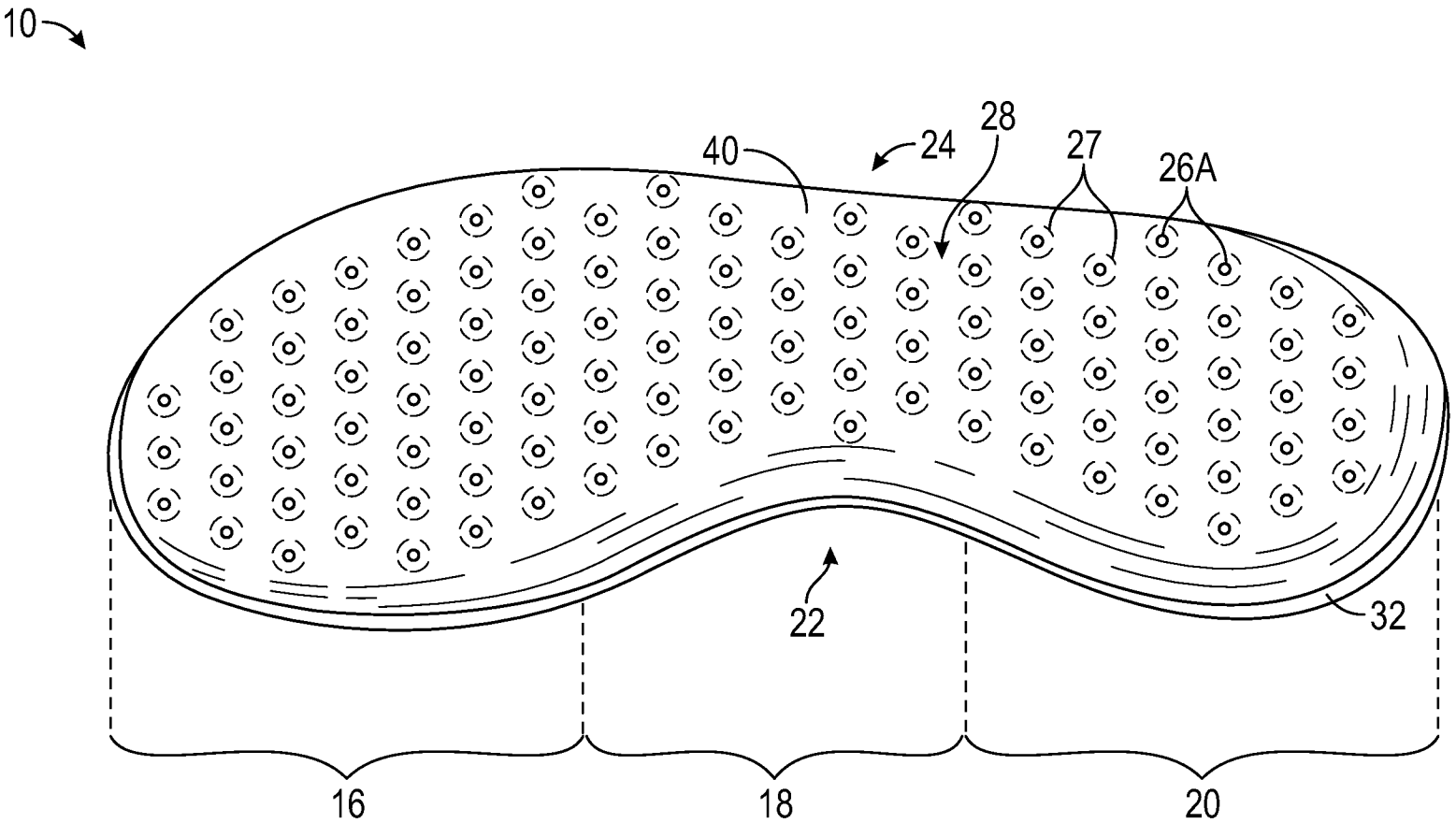
FIG. 1 is a perspective view of a bladder for a footwear sole structure.

The present disclosure generally relates to an article of footwear with a sole structure that includes a bladder having multiple discreet fluid-filled chambers. The chambers are configured (e.g., by pressure, shape, position, and/or size) to elastically deform to provide a desirable cushioning experience. Different geometries of bladders are described herein, each of which has at least four stacked polymeric sheets. Bladders comprised of stacked polymeric sheets are generally easier to assemble and require less dedicated tooling. For example, thermoforming molds are not required to form the bladders. Instead, the geometry of the inflated bladder results mainly from the placement of anti-weld material (e.g., blocker ink) between the stacked polymeric sheets before hot-pressing the sheets to one another. Stated differently, adjacent sheets will bond to one another at areas without anti-weld material. The placement and shape of bonds securing the sheets to one another determines the shape and geometry of the bladder and its fluid chambers, as well as whether the fluid chambers are in communication with one another or isolated from one another, and the cushioning response of various portions of the bladder.

In an example, an article of footwear comprises a sole structure including a bladder that has stacked polymeric sheets including a first polymeric sheet overlying a second polymeric sheet, the second polymeric sheet overlying a third polymeric sheet, and the third polymeric sheet overlying a fourth polymeric sheet. In some examples, there may be more than four stacked polymeric sheets. Peripheries of the stacked polymeric sheets are bonded to one another at a peripheral bond to define a peripheral flange. Adjacent ones of the polymeric sheets are bonded to one another at sets of offset dot bonds to define a first sealed chamber between the first and second polymeric sheets, a second sealed chamber between the second and third polymeric sheets, and a third sealed chamber between the third and fourth polymeric sheets. Each of the first, second, and third sealed chambers retain fluid in isolation from one another.

The sole structure may include a first outsole component extending along a medial side of the bladder at an exterior ground-facing surface of the bladder and partially establishing a ground-engaging surface of the sole structure (e.g., a surface that engages a ground plane underlying the article of footwear). The sole structure may also include a second outsole component disposed along a lateral side of the bladder at the exterior ground-facing surface and further defining the ground-engaging surface of the sole structure. When the sole structure is assembled and in an upright position, the bladder is suspended between the first outsole component and the second outsole component at the ground-facing surface and entirely above the ground-engaging surface. Such a configuration decouples the bending response of the bladder (e.g., deflection of the bladder and stress-strain experience under loading) from the compression response of the bladder.

In another example, an article of footwear comprises a sole structure including a bladder that has stacked polymeric sheets, including a first polymeric sheet overlying a second polymeric sheet, the second polymeric sheet overlying a third polymeric sheet, and the third polymeric sheet overlying a fourth polymeric sheet. Peripheries of the stacked polymeric sheets are bonded to one another at a peripheral bond to define a peripheral flange. The first polymeric sheet is bonded to the second polymeric sheet at a plurality of first dot bonds spaced apart from one another and arranged in offset rows. The first polymeric sheet and the second polymeric sheet enclose a first sealed chamber that surrounds the first dot bonds. The second polymeric sheet is bonded to the third polymeric sheet at a plurality of second bonds so that the second polymeric sheet and the third polymer sheet define a second sealed chamber configured as one or more tubular frames. The third polymeric sheet is bonded to the fourth polymeric sheet at a plurality of third bonds so that the third polymeric sheet and the fourth polymeric sheet define a third sealed chamber configured as one or more domed pods protruding at the fourth polymeric sheet. Each of the domed pods underlies a respective one of the tubular frames of the second chamber, and adjacent domed pods are configured as lobes partially divided by one of the third bonds. The first, second, and third sealed chambers retain fluid in isolation from one another. Such a configuration can provide a relatively flat foot-facing surface for comfort, and a staged compression affording a soft feel due to the load absorption of the relatively large domed pods.

In another example, an article of footwear comprises a sole structure including a bladder that has stacked polymeric sheets including a first polymeric sheet overlying a second polymeric sheet, the second polymeric sheet overlying a third polymeric sheet, and the third polymeric sheet overlying a fourth polymeric sheet. Peripheries of the stacked polymeric sheets are bonded to one another to define a peripheral flange. The first polymeric sheet is bonded to the second polymeric sheet at a plurality of first bonds spaced apart from one another. The first polymeric sheet and the second polymeric sheet enclose a first sealed chamber that surrounds the plurality of first bonds. The second polymeric sheet is bonded to the third polymeric sheet at a plurality of second bonds arranged in continuous closed shapes and offset from the plurality of first bonds so that the second polymeric sheet and the third polymeric sheet enclose a plurality of second sealed chambers each surrounded by one of the continuous closed shapes. The second sealed chambers directly underlie a foot-facing surface of the bladder and directly overlie a ground-facing surface of the bladder. The third polymeric sheet is bonded to the fourth polymeric sheet at a plurality of third bonds spaced apart from one another and offset from the second bonds. Each of the third bonds underlies a respective one of the second sealed chambers opposite a respective one of the first bonds. The third polymeric sheet and the fourth polymeric sheet enclose a third sealed chamber that surrounds the third bonds and directly underlies the first sealed chamber. The first and third sealed chambers retain fluid in isolation from one another and from the second sealed chambers. Because the second sealed chambers establish the full height of the bladder at the second sealed chambers, the cushioning response of the bladder (e.g., the elastic deformation of the bladder under compressive loading) is largely dependent upon the pressure and locations of the second sealed chambers, and can be tuned accordingly.

The above features and advantages and other features and advantages of the present teachings are readily apparent from the following detailed description of the modes for carrying out the present teachings when taken in connection with the accompanying drawings.

Figure 2:
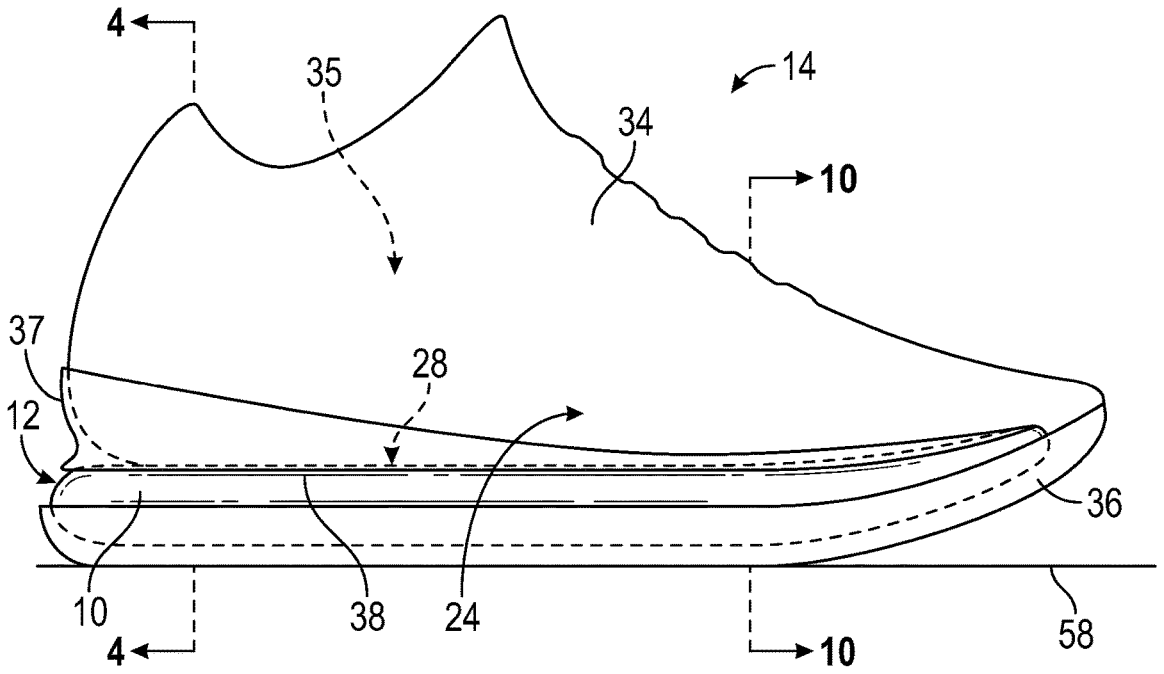
FIG. 2 is a lateral side view of an article of footwear having a sole structure including the bladder of FIG. 1.

Referring to the drawings, wherein like reference numbers refer to like components throughout the views, FIG. 1 shows a full-length bladder 10 that is included in a sole structure 12 of an article of footwear 14 shown in FIG. 2. The bladder 10 is referred to as a full-length bladder as it includes a forefoot region 16, a midfoot region 18, and a heel region 20. The midfoot region 18 is between the heel region 20 and the forefoot region 16. As is understood by those skilled in the art, the forefoot region 16 generally underlies the toes and metatarsal-phalangeal joints of an overlying foot. The midfoot region 18 generally underlies the arch region of the foot. The heel region 20 generally underlies the calcaneus bone. The bladder 10 has a medial side 22 generally shaped to follow the medial side of an overlying foot, and a lateral side 24 generally shaped to follow the lateral side of an overlying foot of a size for which the bladder 10 is configured. As further discussed herein, the bladder 10 has four stacked polymeric sheets. Adjacent sheets of the four stacked polymeric sheets are secured to one another at sets of dot bonds arranged in offset rows at both the foot-facing surface 28 shown in FIG. 1, and the opposing ground-facing surface 30 shown, for example, in FIGS. 3 and 4. First dot bonds 26A secure the first polymeric sheet 40 to an underlying second polymeric sheet 42 (shown in FIG. 4) and are visible in FIG. 1. Only some of the dot bonds 26A and dimples 27 are labelled in FIG. 1. The dot bonds 26A create a dimpled appearance at the foot-facing surface 28 (e.g., at dimples 27), and dot bonds 26C (shown in FIG. 4) likewise create a dimpled appearance at the ground-facing surface 30, but their relatively small size and even spacing enables the foot-facing surface 28 and ground-facing surface 30 to be relatively flat. Only some of the dot bonds 26C are labelled in FIG. 4. The four stacked polymeric sheets are also bonded to one another at a common peripheral flange 32.

FIG. 2 shows the article of footwear 14 including the bladder 10 assembled as a midsole in the sole structure 12. The bladder 10 serves as a midsole. The sole structure 12 is coupled to a footwear upper 34 to define a foot-receiving cavity 35 that receives a foot to support the foot on the sole structure 12. The footwear upper 34 is shown as a sock-like upper that extends under the foot (e.g., across the foot-facing surface 28). Alternatively, a lower extent of the footwear upper 34 could be secured to a strobel that overlies the bladder 10 and/or an insole could be placed over the bladder 10 in the foot-receiving cavity 35.

The sole structure 12 further includes an outsole 36 secured to the ground-facing surface 30, a support rim 37 secured at an outer perimeter 38 of the foot-facing surface 28, and a wedge component 39 secured to the ground-facing surface 30 (see FIG. 3) each of which is discussed herein. Additionally or as an alternative, a foam midsole layer may be secured at the foot-facing surface 28 between the bladder 10 and the footwear upper 34 and/or at the ground-facing surface 30 between the bladder 10 and the outsole 36. Such one or more midsole layers and the bladder 10 together serve as the midsole in such embodiments.

Figure 4:
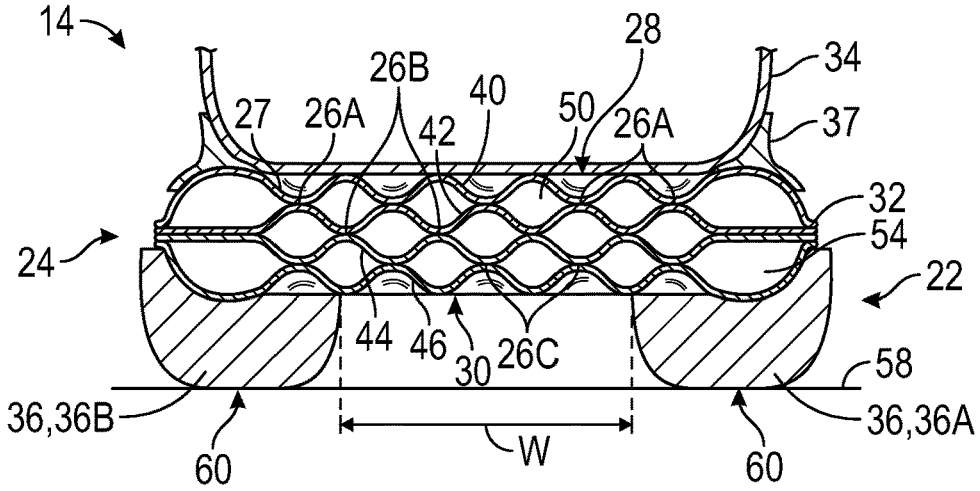
FIG. 4 is a cross-sectional view of the article of footwear of FIG. 2 taken at lines 4-4 in FIG. 2.

Referring to FIG. 4, the bladder 10 includes four stacked polymeric sheets 40, 42, 44, and 46 including the first polymeric sheet 40 overlying a second polymeric sheet 42, the second polymeric sheet 42 overlying a third polymeric sheet 44, and the third polymeric sheet 44 overlying a fourth polymeric sheet 46. An outer periphery of each of the four stacked polymeric sheets 40, 42, 44, and 46 is bonded to the outer periphery of the adjacent polymeric sheet(s) to define the peripheral flange 32. The four stacked polymeric sheets 40, 42, 44, and 46 may be coextensive, each extending to the peripheral flange 32 and having an outer perimeter at the peripheral flange 32.

Figure 5:
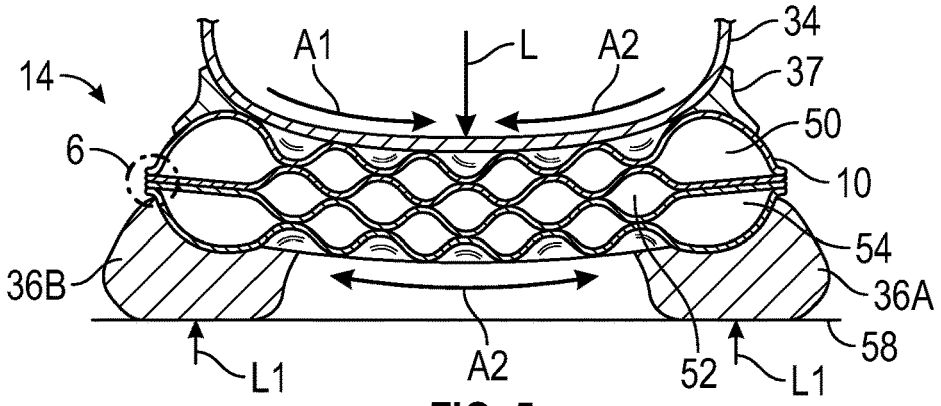
FIG. 5 is a cross-sectional view of the article of footwear of FIG. 2 with the bladder in a first stage of compression.
Figure 6:
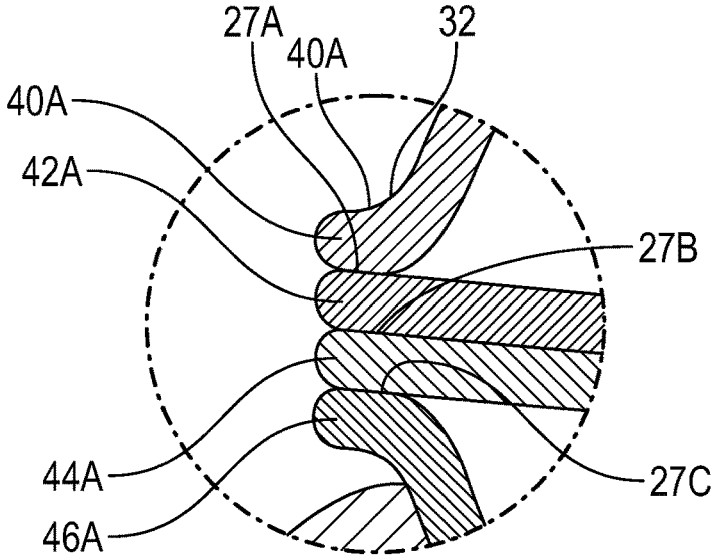
FIG. 6 is a close-up view of a peripheral flange of the bladder of FIG. 5.
Figure 7:
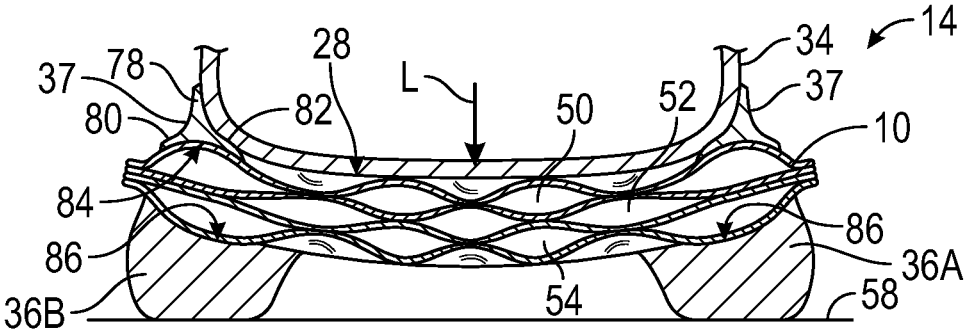
FIG. 7 is a cross-sectional view of the article of footwear of FIG. 2 with the bladder in a second stage of compression.

Additionally, each polymeric sheet 40, 42, 44, and 46 is bonded to each adjacent polymeric sheet by a plurality of bonds disposed inward of the peripheral flange 32. In other words, as shown in FIG. 6, the bottom side of the first polymeric sheet 40 is bonded to the top side of the second polymeric sheet 42 at a peripheral bond 27A at their outer peripheries 40A, 42A and also at first dot bonds 26A (referred to as a first set of dot bonds and only some of which are labelled in FIG. 4). The bottom side of the second polymeric sheet 42 is bonded to the top side of the third polymeric sheet 44 a peripheral bond 27B at their outer peripheries 42A, 44A, and also at second dot bonds 26B (referred to as a second set of dot bonds, only some of which are labelled in FIG. 4). The bottom side of the third polymeric sheet 44 is bonded to the top side of the fourth polymeric sheet 46 at a peripheral bond 27C at their outer peripheries 44A, 46A, and also at third dot bonds 26C (referred to as a third set of dot bonds, only some of which are labelled in FIG. 4). The bond 27B at the outer peripheries 42A, 44A between the second polymeric sheet 42 and the third polymeric sheet 44 extends further inward than the bonds 27A and 27C. The bonds 27A, 27B, 27C are labelled on only one side of the bladder 10 in FIGS. 4 and 5, but it should be understood that the bonds extend around the entire perimeter of the bladder 10 in order to seal the bladder 10 as discussed herein. Inflation ports used to inflate chambers of the bladder 10 are sealed at the outer perimeter at bonds 27A, 27B, 27C after inflation.

The dot bonds 26A are spaced apart from one another, and arranged in rows extending transversely from the medial side 22 to the lateral side 24, as best shown in FIG. 1. Only some of the dot bonds 26A are labelled in FIG. 1. Dot bonds 26A of adjacent rows are offset from one another in the X-Y plane. Stated differently, a dot bond 26A will be disposed at a transverse position midway between a pair of dot bonds 26A in a row forward of the dot bond 26A and a pair of dot bonds 26A in a row rearward of the dot bond 26A. Dot bonds 26B and dot bonds 26C are likewise spaced apart from one another and arranged in offset rows. Additionally, the second dot bonds 26B are transversely offset from the first dot bonds 26A and the third dot bonds 26C in a vertical plane (the Z plane) as is evident in the cross-section of FIG. 4. The third dot bonds 26C are vertically aligned with the first dot bonds 26A in the vertical plane.

With this arrangement of bonds, a first sealed chamber 50 is defined and bounded by, and enclosed between, the first and second polymeric sheets 40, 42. A second sealed chamber 52 is defined and bounded by, and enclosed between, the second and third polymeric sheets 42, 44. A third sealed chamber 54 is defined and bounded by, and enclosed between, the third and fourth polymeric sheets 44, 46. The second sealed chamber 52 is isolated from the first sealed chamber 50 by the second polymeric sheet 42, and the third sealed chamber 54 is isolated from the second sealed chamber 52 by the third polymeric sheet 44. In the embodiment shown, there are only four polymeric sheets and three sealed chambers, and the fourth polymeric sheet 46 defines the ground-facing surface 30. In other embodiments, there may be more than four stacked polymeric sheets creating more than three sealed chambers (e.g., six stacked polymeric sheets creating five sealed chambers) with adjacent sheets bonded to one another with rows of dot bonds, and the dot bonds at alternate pairs of adjacent sheets vertically aligned with one another.

The first, second, third, and fourth polymeric sheets 40, 42, 44, and 46 are a material that is impervious to fluid, such as gas, which may be air, nitrogen, or another gas. Each of the first, second, and third sealed chambers 50, 52, and 54 retain(s) fluid in isolation from each other sealed chamber 50, 52, and 54. This enables the first sealed chamber 50 to retain a gas at a first predetermined pressure, the second sealed chamber 52 to retain a gas at a second predetermined pressure, and the third sealed chamber 54 to retain a gas at a third predetermined pressure. The pressures may be the same or different from one another, and may be at or above ambient pressure.

The first sealed chamber 50 retains fluid as a first cushioning layer. The first sealed chamber 50 extends over the forefoot region 16, the midfoot region 18, and the heel region 20. The first sealed chamber 50 is the only sealed chamber of the bladder 10 that is disposed at and defines the foot-facing surface 28. A foot supported on the bladder 10 therefor has the first sealed chamber 50 underlying the expanse of the foot in each of the forefoot region 16, the midfoot region 18, and the heel region 20. The inflation pressure of the first sealed chamber 50 significantly impacts a wearer's perception of the stiffness of the bladder 10 as the first sealed chamber 50 is closer to the foot than any of the other sealed chambers 52 and 54 formed by the bladder 10.

The dot bonds 26A in FIG. 1 are shown as small circles, but dot bonds 26A, as well as dot bonds 26B and 26C, may be other closed shapes instead, such as a square or a triangle. The dot bonds 26A are formed at areas not covered by blocker ink in a pattern of printed blocker ink applied to the bottom side of the first polymeric sheet 40 and/or a pattern of printed blocker ink applied to the top side of the second polymeric sheet 42. The foot-facing surface 28 also has a plurality of dimples 27 at the plurality of dot bonds 26A as each dot bond 26A causes the first polymeric sheet 40 to recess toward the dot bond 26A when the first sealed chamber 50 is inflated, creating a dimple 27. A corresponding dimple 27 is created in the second polymeric sheet 42 around where it is restrained at the dot bond 26A. Only some of the dimples 27 and dot bonds 26A are indicated with reference numbers in FIG. 1. The dot bonds 26A act to limit the overall distance between the polymeric sheets 40, 42 when the first sealed chamber 50 is inflated, limiting the height of the first sealed chamber 50.

The first sealed chamber 50 surrounds each of the dot bonds 26A between the first polymeric sheet 40 and the second polymeric sheet 42, and the fluid in the sealed chamber 50 communicates around each of the dot bonds 26A. The second sealed chamber 52 surrounds each of the dot bonds 26B between the second polymeric sheet 42 and the third polymeric sheet 44, and the fluid in the sealed chamber 52 communicates around each of the dot bonds 26B. The third sealed chamber 54 surrounds each of the dot bonds 26C between the third polymeric sheet 44 and the fourth sheet 46, and the fluid in the sealed chamber 54 communicates around each of the dot bonds 26C.

During a forward foot roll in which dynamic loading begins at the heel region 20 and moves forward, gas in the first sealed chamber 50 is easily displaced from rear to front, freely moving in the first sealed chamber 50 around the dot bonds 26A. Similarly, gas in the second sealed chamber 52 is displaced from rear to front around the dot bonds 26B, and gas in the third sealed chamber 54 is displaced from rear to front around the dot bonds 26C. Preloading of the midfoot region 18 and the forefoot region 16 will thus occur due to the displaced gas from the heel region 20 as the foot compresses the bladder 10 with an initial heel strike and a roll forward, increasing the stiffness of the midfoot region 18, and then of the forefoot region 16 during the forward roll. This may beneficially provide a relatively stiff, supportive platform for toe off.

The cushioning response of the bladder 10 is therefore staged not only in relation to absorption of a vertical impact force by the bladder 10 by sealed chambers 50, 52, and 54 working in stages as described herein, but also in relation to the forward roll of the foot from heel to toe. Displacement of gas within each of the chambers 50, 52, and 54 may also be transverse, such as during a lateral push off or landing, or from front to rear, such as when jumping and landing on the forefoot region 16 of the bladder 10.

Selection of the shape, size, and location of the various bonds between the polymeric sheets 40, 42, 44, and 46 as well as the inflation pressures of the chambers 50, 52, and 54 provides the desired contoured surfaces of the inflated bladder 10, including the relatively flat foot-facing surface 28 and ground-facing surface 30. Prior to bonding, the polymeric sheets 40, 42, 44, and 46 are stacked, flat sheets that are coextensive with one another. Anti-weld material is applied to interfacing surfaces of the polymeric sheets 40, 42, 44, and 46 where bonds are not desired. For example, the anti-weld material may be referred to as blocker ink, and may be ink-jet printed according to a programmed pattern at selected locations on the sheets where bonds between adjacent sheets are not desired. The stacked, flat polymeric sheets 40, 42, 44, and 46 are then heat pressed to create bonds between adjacent sheets on all adjacent sheet surfaces except for where the anti-weld material was applied. No thermoforming molds or radio frequency welding is necessary to form the bladder 10. In the completed (e.g., fully formed) bladder 10, areas where the anti-weld material was applied will be at the internal volumes of the various sealed chambers 50, 52, and 54.

Once bonded, the polymeric sheets 40, 42, 44, and 46 remain flat, and take on the contoured shape of the bladder 10 only when the chambers 50, 52, and 54 are inflated through fill ports that are then sealed. Accordingly, if the inflation gas is removed, and assuming other components are not disposed in any of the sealed chambers, and the polymeric sheets 40, 42, 44, and 46 are not yet bonded to other components such as an outsole, other midsole layers, or an upper, the polymeric sheets 40, 42, 44, and 46 will return to their initial, flat state.

The polymeric sheets 40, 42, 44, and 46 can be formed from a variety of materials including various polymers that can resiliently retain a fluid such as air or another gas. Examples of polymer materials for the polymeric sheets 40, 42, 44, and 46 include thermoplastic urethane, polyurethane, polyester, polyester polyurethane, and polyether polyurethane. Moreover, the polymeric sheets 40, 42, 44, and 46 can each be formed of layers of different materials. In one embodiment, each polymeric sheet 40, 42, 44, and 46 is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet 40, 42, 44, and 46 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets 40, 42, 44, and 46 may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets 40, 42, 44, and 46 are disclosed in U.S. Pat. Nos. 4,183,156 and 4,219,945 to Rudy which are incorporated by reference in their entireties. Further suitable materials for the polymeric sheets 40, 42, 44, and 46 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets 40, 42, 44, and 46, engineering properties such as tensile strength, stretch properties, fatigue characteristics, dynamic modulus, and loss tangent can be considered. The thicknesses of polymeric sheets 40, 42, 44, and 46 can be selected to provide these characteristics.

Because they are isolated from one another, the sealed chambers 50, 52, and 54 may be filled with gas at the same or at different inflation pressures to achieve a desired cushioning response. For example, the discreet third sealed chamber 54, which is closer to the ground during use than the first sealed chamber 50, may have a lower inflation pressure than the first sealed chamber 50. Each sealed chamber 50, 52, and 54 retains gas at a predetermined pressure to which it is inflated when the bladder 10 is in an unloaded state. The unloaded state is the state of the bladder 10 when it is not under either steady state loading or dynamic loading. For example, the unloaded state is the state of the bladder 10 when it is not bearing any loads, such as when it is not worn on a foot. A dynamic compressive load on the bladder 10 is due to an impact of the sole structure 12 with the ground, indicated by ground plane 58, and the corresponding footbed load of a person wearing the article of footwear 14 having the bladder 10 and an opposite ground load. The dynamic compressive load may be absorbed by the chambers 50, 52, and 54 of the bladder 10 in a sequence according to increasing magnitudes of the stiffness from least stiff to most stiff, with higher inflation pressures associated with greater stiffness. Generally, a smaller volume chamber will reach a maximum displacement under a given dynamic load faster than a larger volume chamber of the same or lower inflation pressure, providing return energy faster than the larger volume chamber.

Stiffness of a cushioning layer such as a sealed fluid chamber is indicated by a plot of force versus displacement under dynamic loading, with stiffness being the ratio of change in compressive load (e.g., force in Newtons) to displacement of the cushioning layer (e.g., displacement in millimeters along the axis of the compressive load). The compressive stiffness of different portions of the bladder 10 would be dependent in part upon the relative inflation pressures. Assuming the four stacked polymeric sheets 40, 42, 44, 46 are of the same material or materials and construction, and are of equal thickness, a chamber of equal volume and shape as another chamber but with a lower inflation pressure should experience greater initial displacement under dynamic loading, providing an initial stage of relatively low stiffness, followed by a subsequent stage of greater stiffness after reaching its maximum compression. An equal volume chamber of a greater inflation pressure or a lower volume chamber of equal inflation pressure should provide a steeper ramp in stiffness on a load versus displacement curve.

Figure 3:
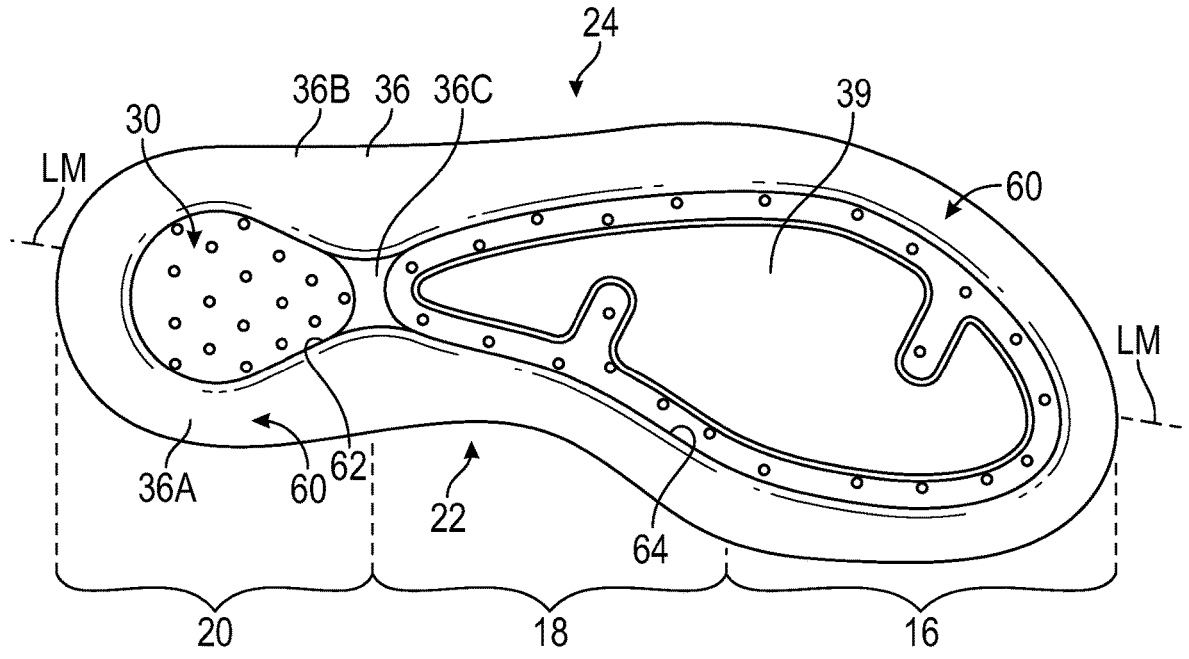
FIG. 3 is a bottom view of the article of footwear of FIG. 2.

As shown in FIG. 3, the outsole 36 includes a first outsole component 36A extending along the medial side 22 of the bladder 10 at the exterior ground-facing surface 30 and a second outsole component 36B extending along the lateral side 24 of the bladder 10 at the exterior ground-facing surface 30. In the embodiment shown, the outsole components 36A, 36B are integral portions of a single, unitary outsole 36. Alternatively, the outsole components 36A, 36B could each be discrete, separate components of a multi-piece outsole. The first and second outsole components 36A, 36B each partially establish a ground-engaging surface 60 of the article of footwear 14. The ground-engaging surface 60 engages the ground plane 58 even in an unloaded state, and also during loading, when the footwear 14 is disposed with the sole structure 12 between the footwear upper 34 and the ground plane 58 (e.g., when a person wearing the article of footwear 14 stands upright).

As indicated in FIG. 3, the outsole 36 generally rings the perimeter of the ground-facing surface 30 of the bladder 10, and has an aperture 62 in the heel region 20 and an aperture 64 in the forefoot and midfoot regions 16, 18. The first outsole component 36A may be considered that portion of the outsole 36 extending along the entire medial side 22 from the forefoot region 16 to the heel region 20, and the second outsole component 36B may be considered that portion of the outsole 36 extending along the entire lateral side 24 from the forefoot region 16 to the heel region 20, with the outsole components 36A and 36B falling on opposite sides of the longitudinal midline LM. A cross-member portion 36C of the outsole 36 traverses from the first outsole component 36A to the second outsole component 36B, but is of a lesser height, so does not extend sufficiently below the bladder 10 to form part of the ground-engaging surface 60. The cross-member portion 36C separates the apertures 62, 64. With this configuration of the outsole 36, the bladder 10 is suspended from and spans between the first outsole component 36A and the second outsole component 36B at the ground-facing surface 30 entirely above the ground-engaging surface 60, as best shown in FIG. 4. This is true in the heel region 20 as depicted in FIG. 4, and also in the forefoot region 16 and midfoot region 18 because the wedge component 39 also does not extend to form part of the ground-engaging surface 60 when unloaded and even during dynamic loading, except under extreme lateral (shear) force such as during dynamic banking as discussed herein. In other configurations, the outsole components 36A, 36B could extend only in the heel region 20, or only in the heel region 20 and the midfoot region 18, or only in the forefoot region 16, or only in the forefoot region and the midfoot region 18, or only in the heel region 20 and the forefoot region 16, for example, so that the suspended state of the bladder 10 is in only one or more of the regions 16, 18 and 20 rather than in all of the regions 16, 18, and 20.

FIG. 4 represents the bladder 10 in an initial, unloaded state. FIG. 5 represents the bladder 10 during a first stage of compressive loading, represented by load L and reaction loads L1 at the outsole 36. The load L and reaction loads L1 may represent dynamic compressive loading on the sole structure 12 such as due to an impact of the sole structure 12 with the ground plane 58 under a footbed load L1 of a person wearing the article of footwear 14 having the bladder 10 and an opposite reaction load L1 of the ground against the sole structure 12. Because of the suspended configuration of the bladder 10 relative to the outsole components 36A, 36B, the bladder 10 bends like a beam in addition to displacing due to compression of the fluid in the chambers 50, 52, and 54. The outsole 36 may also compress under loading, affecting the overall stiffness profile of the sole structure 12.

The order of bending and compressing of the bladder 10, and any overlap of a bending response and a compression response due to the dynamic compressive load L, may be controlled (i.e., tuned) as desired when designing the bladder 10, by selecting the materials for the bladder 10, the inflation pressures of the chambers 50, 52, and 54, as well as the width W of the span between the outsole components 36A, 36B over which the bladder 10 is suspended. For example, FIG. 5 illustrates the compounded stress-strain beam mechanics of the bending bladder 10, with transversely-inward compression near the foot-facing surface 28 of the bladder 10 (as represented by inward arrows A1) and tension near the ground-facing surface 30 of the bladder 10

Figure 8:
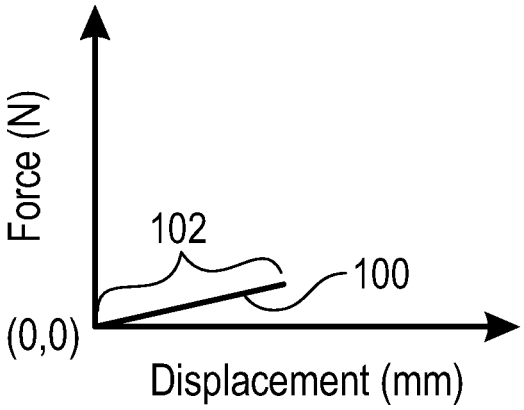
FIG. 8 is a plot of force versus displacement during the first stage of compression shown in FIG. 5.
Figure 9:
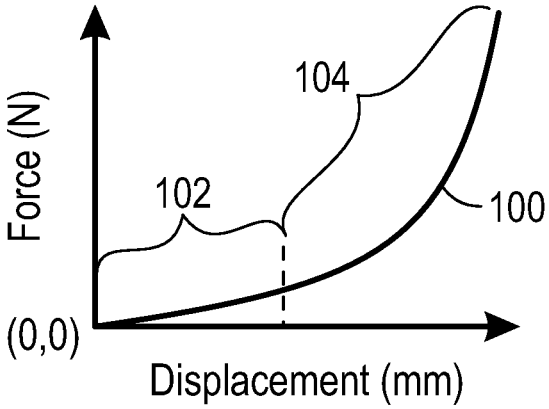
FIG. 9 is a plot of force versus displacement during the second stage of compression shown in FIG. 7.

(as represented by double-sided outward arrow A2). Stated differently, the bladder 10 functions like a semi-rigid composite beam during a bending stage of reacting to the compressive load L illustrated in FIG. 5. The plot of FIG. 8 shows that force (load L in Newtons) versus displacement (e.g., vertical displacement of the bladder 10 in millimeters) is represented by portion 102 of the load versus displacement curve 100 during bending of the bladder 10 as described with respect to FIG. 5. With an increase in the magnitude of the load, the bladder 10 deflects further, decreasing in width by compressing the gas in the sealed chambers 50, 52, and 54 in an order according to their increasing pressures. The portion 104 of the load versus displacement curve during this stage is shown in FIG. 9, and represents a nonlinear increase in stiffness of the bladder 10 with increasing load.

Figure 10:
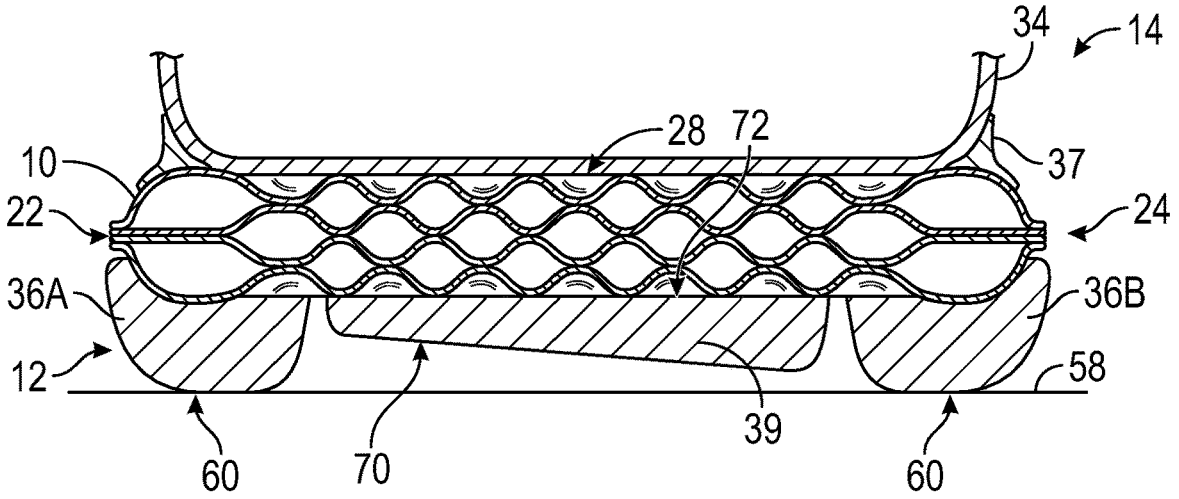
FIG. 10 is a cross-sectional view of the article of footwear of FIG. 2 taken at lines 10-10 in FIG. 2 and showing a wedge component above a ground plane.
Figure 11:
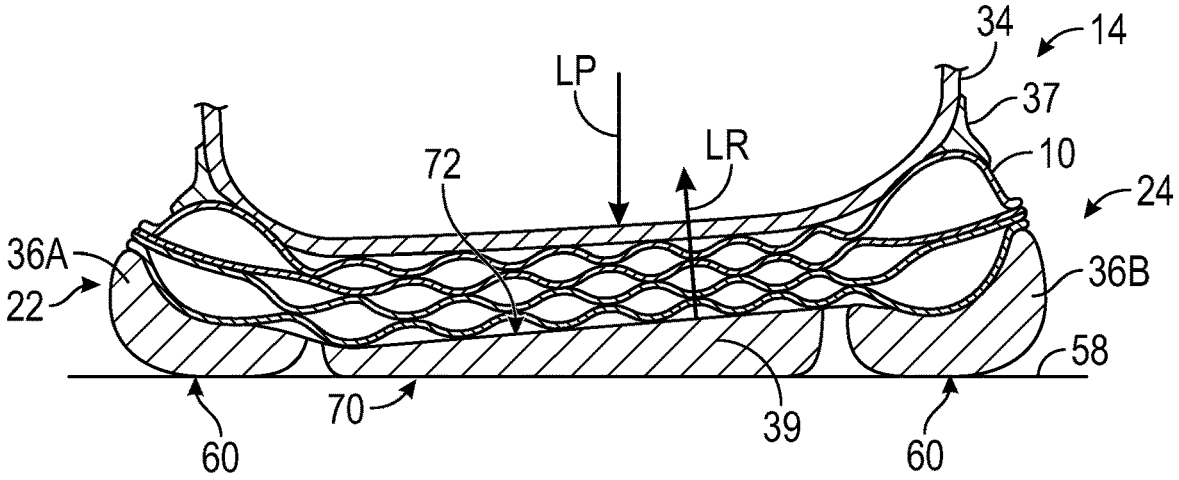
FIG. 11 is cross-sectional view of the article of footwear of FIG. 10 under a compressive load showing the wedge component contacting the ground plane.

With the beam function (bending) and displacement (compression) of the bladder 10 decoupled (e.g., dependent upon different characteristics of the bladder 10), compression of the bladder 10 can be utilized to engage elements of the sole structure 12 independently. Support structures such as banking wedges and/or pressure mapped surfaces in the outsole 36 or underlying midsole layers can be tuned to engage during deep compression. For example, with reference to FIG. 10, the wedge component 39 increases in thickness in a direction from the medial side 22 toward the lateral side 24 of the bladder 10 such that a ground-facing surface 70 of the wedge component 39 is non-parallel with the ground plane 58 and is entirely above the ground-engaging surface 60 of the sole structure 12 in the absence of a threshold compressive load applied at the foot-facing surface 28. For example, once the magnitude of the load reaches the predetermined magnitude, as represented by load LP in FIG. 10, the ground-facing surface 70 becomes part of the ground-engaging surface of the sole structure 12, spreading the load over a greater surface area. More specifically, the ground-engaging surface includes both surface 60 and surface 70.

Moreover, the foot-facing surface 72 of the wedge component 39 may be configured to be generally parallel with the ground-plane 58 in the unloaded state, and nonparallel with the ground plane 58 under the load LP so that a reaction force LR of the surface 72 of the wedge component 39 against the bladder 10 (e.g., a force normal to the surface 72) is at an angle to vertical and has a component extending from the lateral side 24 toward the medial side 22, the wedge component 39 thereby reacting lateral forces (e.g., forces directed from the medial side 22 toward the lateral side 24), such as to react a side-to-side or "banking" movement).

Figure 12:
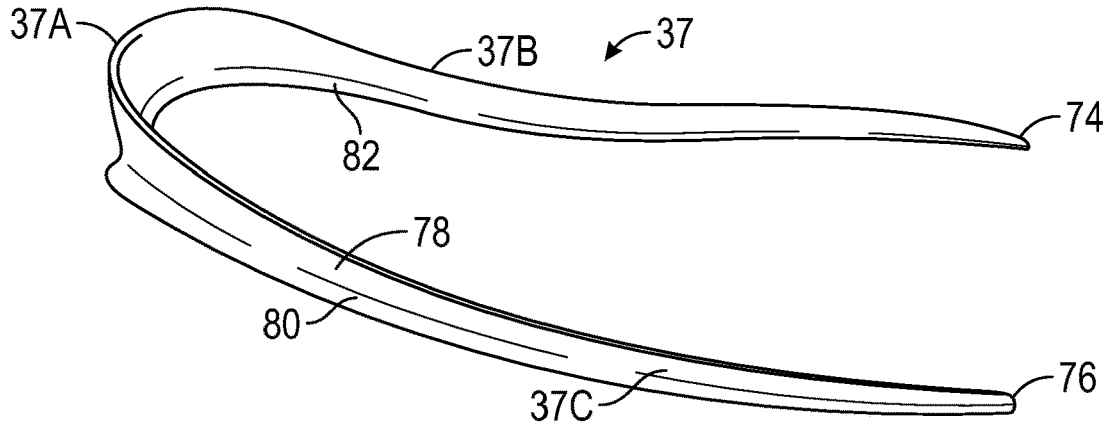
FIG. 12 is a perspective view of a support rim included in the sole structure of FIG. 2.

Referring now to FIG. 12, the support rim 37 is shown in isolation. As is apparent, the support rim 37 is generally U-shaped, including an arcuate heel portion 37A, a medial arm portion 37B, and a lateral arm portion 37C. The medial arm portion 37B extends forward from the heel portion 37A and terminates at a medial end 74. The lateral arm portion 37C extends forward from the heel portion 37A and terminates at a lateral end 76. As shown in FIGS. 2, 4, 5, 7, and 10-11, the support rim 37 is secured to the foot-facing surface 28 of the bladder 10 along an outer perimeter of the bladder 10. In cross-sectional view, as in FIG. 7, it is apparent that the support rim 37 has three flanges, including an upper exterior flange 78, a lower exterior flange 80, and an interior flange 82. When assembled in the footwear 14, the upper exterior flange 78 extends upward along and is secured to an outer surface of the footwear upper 34. The interior flange 82 extends inward between and is secured to both the footwear upper 34 and the foot-facing surface 28 of the bladder 10. The lower exterior flange 80 is also secured to the bladder 10, extending downward along an outer perimeter of the bladder 10 below the footwear upper 34. The support rim 37 has a concave lower surface 84 that mates to the rounded exterior at the upper perimeter of the bladder 10. The inner surfaces 86 (see FIG. 7) of the outsole components 36A, 36B are also rounded to mate to the rounded exterior at the lower perimeter of the bladder 10, providing support at the outer perimeter of the bladder 10 (e.g., along the sidewalls of the bladder 10). With this configuration, the support rim 37 provides transverse support against side-to-side movement of the footwear upper 34 relative to the bladder 10. Additionally, the concave surfaces 84, 86 of the support rim 37 and the outsole components 36A, 36B largely cup the outer sides of the bladder 10, reacting shear forces (side-to-side forces) acting on the bladder 10.

Figure 13:
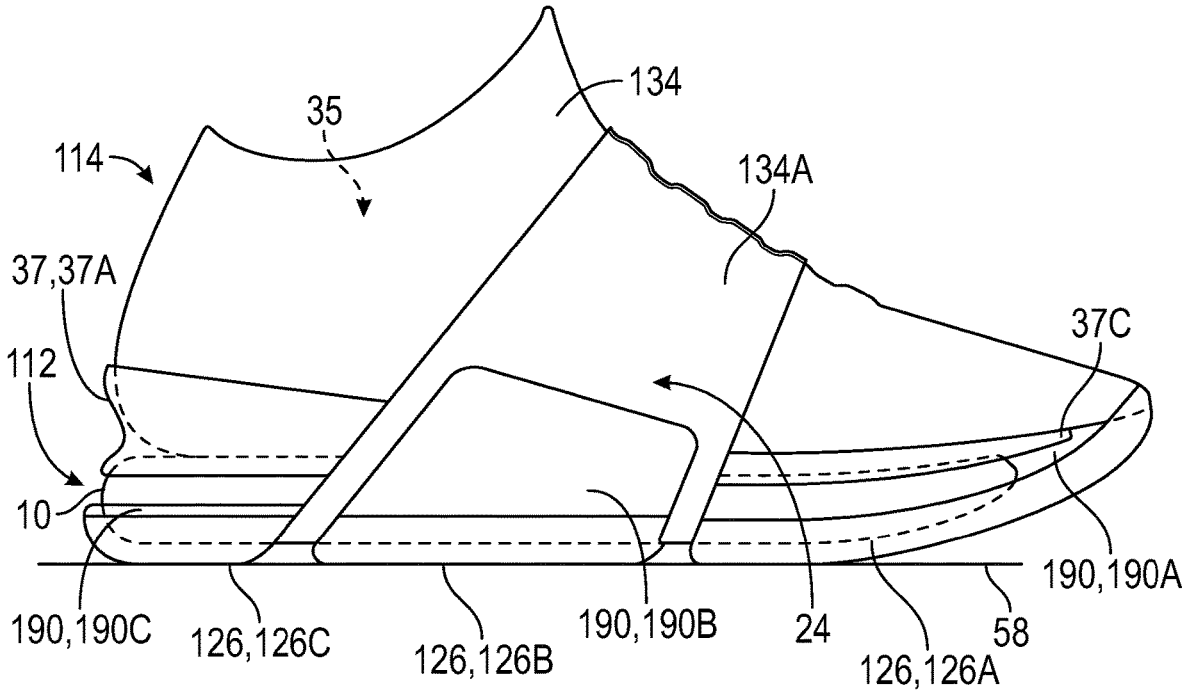
FIG. 13 is a lateral side view of another article of footwear having a sole structure including the bladder of FIG. 1.
Figure 14:
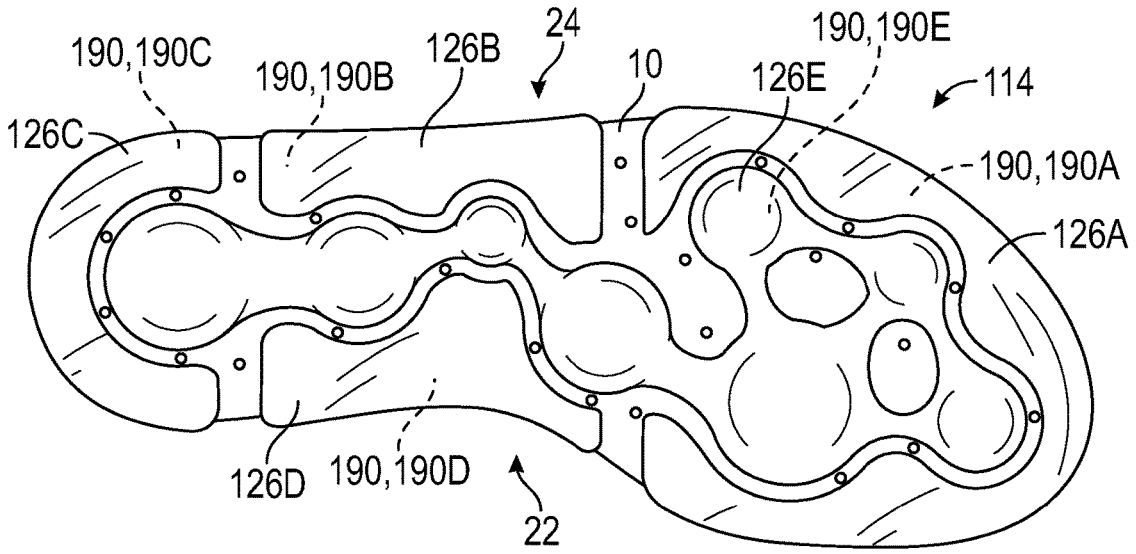
FIG. 14 is a bottom view of the article of footwear of FIG. 13.

FIG. 13 is a lateral side view of another article of footwear 114 having a sole structure 112 coupled to an upper 134. The sole structure 112 includes the bladder 10 of FIG. 1. The footwear upper 134 may include a band portion 134A in the midfoot region that surrounds the foot-receiving cavity 35 from the sides 22, 24 and above. FIG. 14 is a bottom view of the article of footwear 114 of FIG. 13. The sole structure 112 includes a foam midsole layer 190 disposed below and secured to the bladder 10. The foam midsole layer 190 is comprised of discrete midsole layer components 190A, 190B, 190C, 190D, and 190E, as shown in FIG. 13. Because the midsole layer components 190B and 190D wrap upward along the exterior surface of the footwear upper 34 at the lateral and medial sides 24, 22, respectively, the support rim 37 is discontinuous between the heel portion 37A and the lateral arm portion 37C and a medial arm portion (not shown). Stated differently, the support rim 37 includes three separate, discrete components: heel portion 37A, lateral arm portion 37C, and medial arm portion (not shown)

The sole structure 112 also includes an outsole 126 that is comprised of discrete components 126A, 126B, and 126C underlying the foam midsole layer 190. For example, outsole components 126A, 126B and 126C underlie foam midsole layer components 190A, 190B, and 190C, respectively, as seen in FIG. 13. Additional outsole components 126D, 126E underlie midsole layer components 190D and 190E, respectively. Referring to FIG. 14, the midsole layer component 190E and outsole component 126E (if any) secured thereto may be of a lesser thickness than the surrounding midsole layer components 190A, 190B, 190C, and 190D so that the bladder 10 is suspended above the ground plane by the midsole layer components 190A, 190B, 190C, and 190D and their respective underlying outsole components 126A, 126B, 126C, and 126D to function as a beam during compression of the sole structure 112 similarly as described with respect to sole structure 12. Under a sufficient compressive load, the outsole component 126E underlying midsole layer component 190E will contact the ground plane 58, and the midsole layer component 190E will compress, affecting the stiffness profile of the sole structure 112. The midsole layer component 190E is configured with rounded nodular portions that may correspond in position to relatively high pressure areas of a pressure map of loading by an average wearer (which may be based on a database of a population of wearers) so that the engagement of the midsole layer component 190E provides additional cushioning at portions of the foot according to the pressure map.

Figure 15:
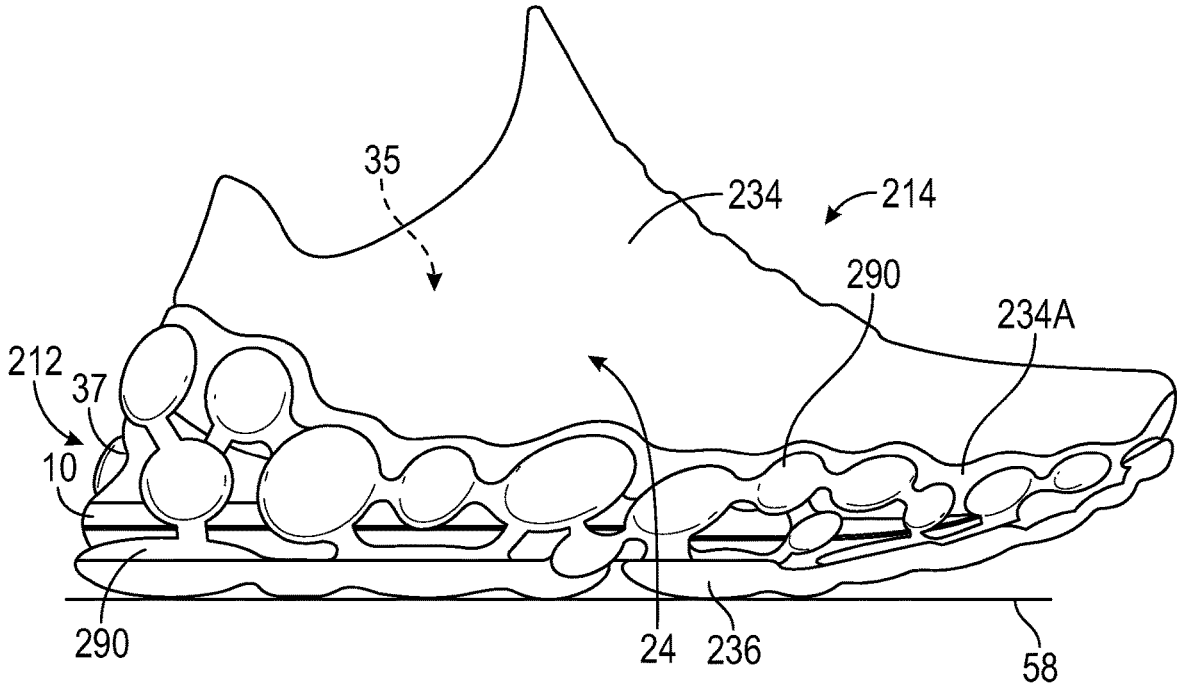
FIG. 15 is a lateral side view of another article of footwear having a sole structure including the bladder of FIG. 1.

FIG. 15 shows another article of footwear 214 that has a sole structure 212 including the bladder 10. The sole structure 212 also includes a foam midsole layer 290 that underlies the bladder 10, and an outsole 236 that underlies the foam midsole layer 290 and establishes a ground-engaging surface of the sole structure 212. Both the foam midsole layer 290 and the outsole 236 are comprised of interconnected podular shapes. Similar to sole structures 12 and 112, the podular shapes of the midsole layer 290 and the outsole 236 may be arranged and configured so that the bladder 10, spans between and over outsole components that extend along the medial and lateral sides of the bladder 10 enabling the bladder 10 to bend as a beam during compressive loading of the sole structure 212. Like sole structure 112, at least some of the podular shapes of the midsole layer 290 may correspond with a pressure map of a foot. The foam midsole layer 290 also extends upward along exterior sides of the bladder 10 and onto an outer surface of the footwear upper 234 at a lower portion of the footwear upper 234. The footwear upper 234 may include a lower reinforcement 234A of a relatively stiff material to which the foam midsole layer 290 may be bonded.

Figure 16:
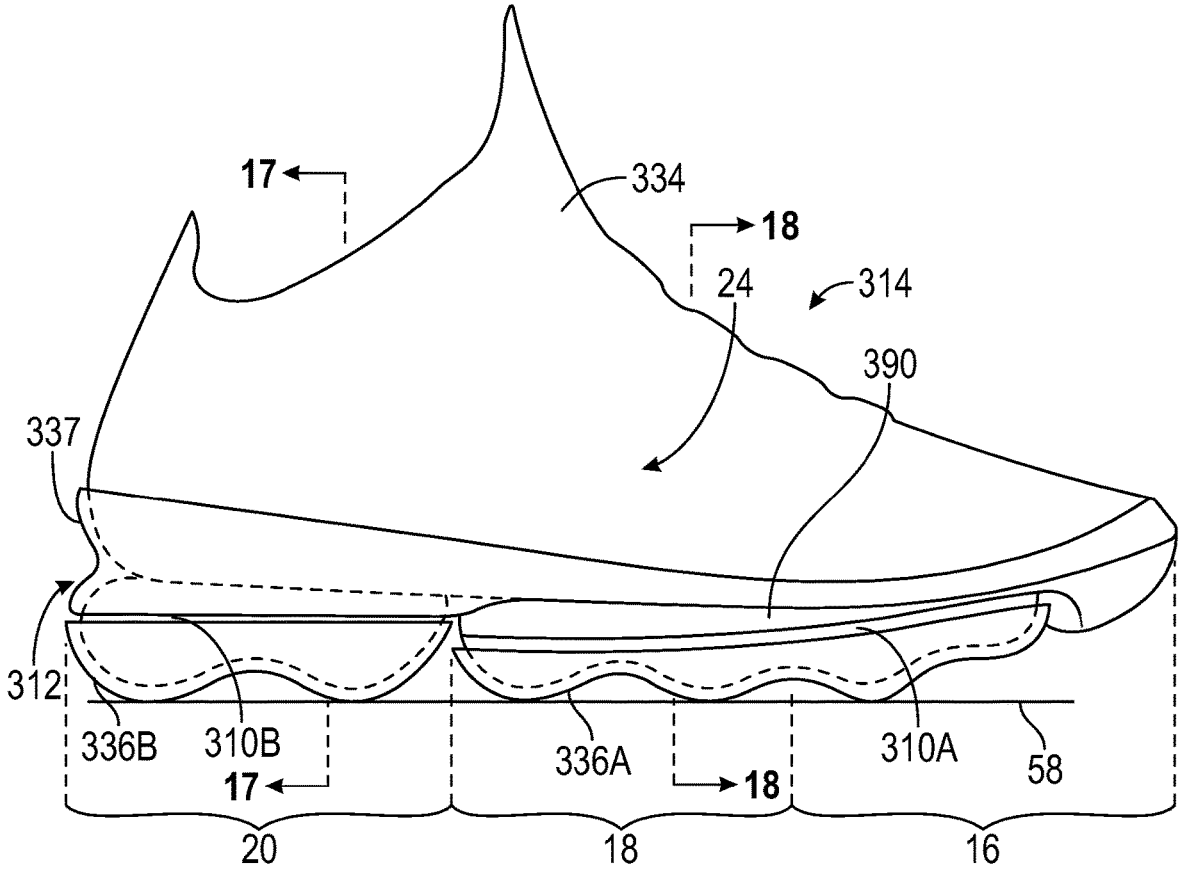
FIG. 16 is a lateral side view of an article of footwear having a sole structure including a forefoot bladder and a heel bladder.

FIG. 16 shows an article of footwear 314 that includes a sole structure 312 coupled to an upper 334. The sole structure 312 includes both a forefoot bladder 310A and a heel bladder 310B, each of which includes four stacked polymeric sheets 40, 42, 44, and 46 as described with respect to the bladder 10, but with a different pattern of bonds to provide first, second, and third sealed chambers of different shapes than the chambers of the bladder 10, affording a different cushioning response as further described herein. A midsole layer 390 and a support rim 337 are also included in the sole structure 312, and are discussed further herein.

It should be appreciated that the forefoot bladder 310A and the heel bladder 310B may be completely separate and isolated from one another, each with a separate peripheral flange 32 (shown in FIGS. 17-18) at which the respective four polymeric sheets are bonded to one another. The four polymeric sheets of each bladder 310A, 310B are referred to with the same reference numbers, e.g., polymeric sheets 40, 42, 44, and 46, for clarity in the description, and as each may be cut from the same larger sheet, for example, before bonding at separate peripheral bonds. In the assembled footwear, the sheets 40, 42, 44, and 46 of the forefoot bladder 310A are separate from (i.e., disconnected from) the sheets 40, 42, 44, and 46 of the heel bladder 310B.

Figure 17:
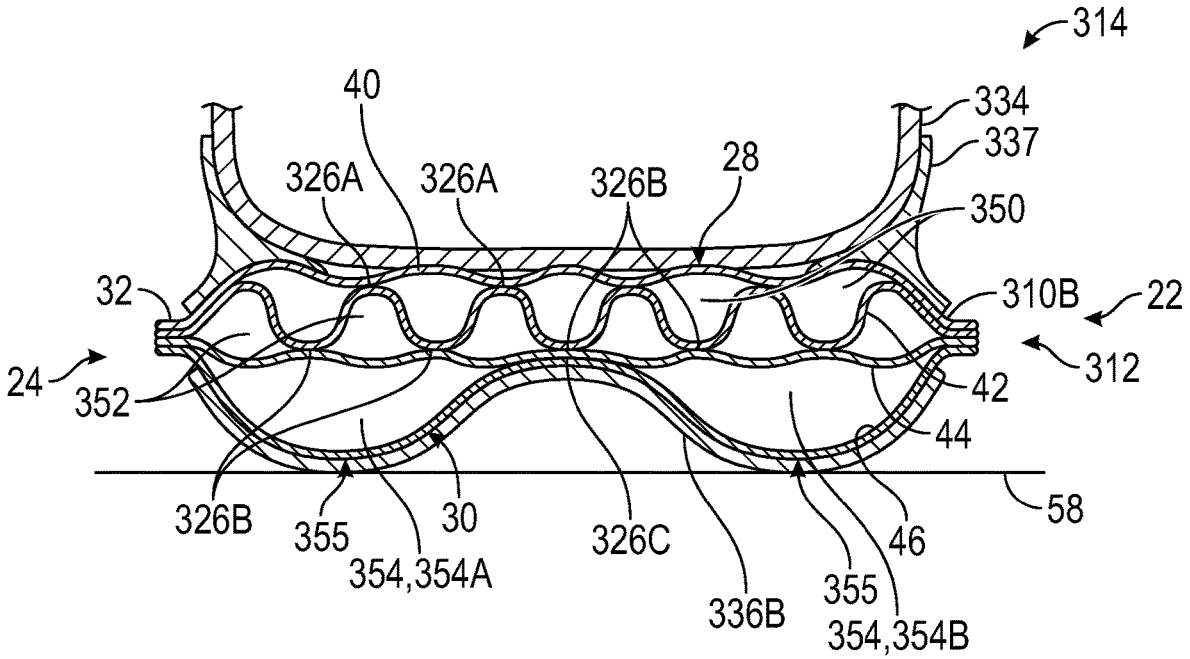
FIG. 17 is a cross-sectional view of the article of footwear of FIG. 16 taken at lines 17-17 in FIG. 16.

More particularly, with reference to FIG. 17 showing the heel bladder 310B, the first polymeric sheet 40 is bonded to the second polymeric sheet 42 at a plurality of first dot bonds 326A spaced apart from one another and arranged in offset rows in the same manner as shown in FIG. 1 with respect to dot bonds 26. The first polymeric sheet 40 and the second polymeric sheet 42 enclose a first sealed chamber 350 that surrounds (and communicates around) the first dot bonds 326A. Only some of the dot bonds 326A are labelled in FIG. 17. The second polymeric sheet 42 is bonded to the third polymeric sheet 44 at a plurality of second bonds 326B so that the second polymeric sheet 42 and the third polymer sheet 44 define a second sealed chamber 352 that is arranged as one or more tubular frames surrounded by the second bonds 326B. Only some of the second bonds 326B are labelled in FIG. 17. As used herein, a tubular frame is a sealed chamber extending in a continuous, closed shape, such as an annular ring that may be circular, trapezoidal, square, triangular, etc. The tubular frames of the second sealed chamber 352 may be isolated from one another, or in fluid communication with one another, as further discussed with respect to FIGS. 26 and 29. The second polymeric sheet 42 separates the first sealed chamber 350 from the second sealed chamber 352.

Bonds 326C between the third polymeric sheet 44 and the fourth polymeric sheet 46 surround one or more closed shapes each of which may be interconnected or fluidly isolated from one another and form a portion of a third sealed chamber 354. Bonds 326C may be referred to as a plurality of third bonds or third bonds. When the third sealed chamber 354 is inflated, each closed shape has a lower domed surface 355 (only one is labelled in FIG. 18). Accordingly, each portion of the third sealed chamber 354 may be referred to as a domed pod. For example, in FIG. 17, two domed pods 354A, 354B of the third sealed chamber 354 are shown. The third sealed chamber 354 and each domed pod 354A, 354B thereof is fluidly isolated from the first sealed chamber 350 and from the second sealed chamber 352. The domed pods of the third sealed chamber 354 may also be fluidly isolated from one another, or some may be in fluid communication with one another, as discussed with respect to FIGS. 27 and 30. In this manner, in addition to the first and second sealed chambers 350, 352 retaining fluid at different predetermined fluid pressures, each of the domed pods of the third sealed chamber 354 can also retain fluid at a different fluid pressure, or at the same fluid pressure if connected by a channel. For example, the domed pod 354A may have a different fluid pressure than domed pod 354B, or they may be interconnected by a channel in some embodiments, so that they have the same fluid pressure.

Figure 18:
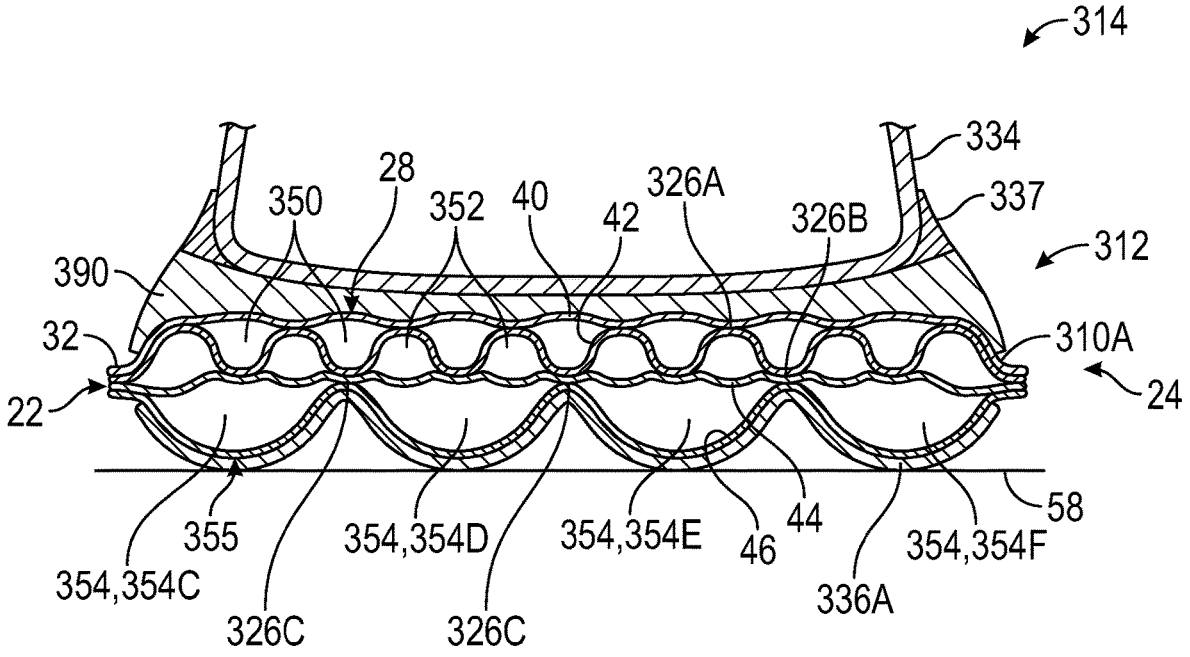
FIG. 18 is a cross-sectional view of the article of footwear of FIG. 16 taken at lines 18-18 in FIG. 16.

For clarity in the description, the forefoot bladder 310A of FIG. 18 is shown using the same reference numbers used to describe the first, second, and third sealed chambers 350, 352, and 354 of the heel bladder 310B, although it is understood that the forefoot bladder 310A may be a separate bladder with the first, second, and third chambers each isolated from the first, second, and third sealed chambers of the heel bladder 310B. In the cross-section shown, the third sealed chamber 354 of the forefoot bladder 310A has four domed pods 354C, 354D, 354E, and 354F. Only some of the bonds 326A, 326B, and 326C of the forefoot bladder 310A are labelled in FIG. 18, and are configured as described with respect to the like bonds of the same reference numbers in the heel bladder 310B of FIG. 17.

Because the bonds 326A are dot bonds, the first sealed chamber 350 extends in the entire X-Y plane of the bladder 310B and provides a foot-receiving surface. As is evident in FIG. 17, multiple ones of the first dot bonds 326A as well as multiple ones of the second bonds 326B are disposed above a single one of the domed pods 354A or 354B defined by the second sealed chambers 354 due to the relatively wide spacing between the third bonds 326C. This helps create the relatively large height of each of the domed pods of the third sealed chamber 354, enabling them to provide a relatively large displacement under compressive loading, resulting in a relatively soft cushioning feel underfoot.

In one implementation, the third sealed chamber 354 (e.g., the domed pods thereof) may have a lower inflation pressure than the first sealed chamber 350, which has a lower inflation pressure than the second sealed chamber 352. This system provides for a staged response, based on the compression of the soft high volume domed pods of the third sealed chamber 354, followed by the compression of the first sealed chamber 350, and convergence of the compressing first and third sealed chambers 350, 354 on the higher pressure second sealed chamber 352, which functions as an inner frame providing stability. The relatively large displacement of the domed pods of the third sealed chamber 354 dominates the staged response, yielding a soft and bouncy ride profile.

Figure 19:
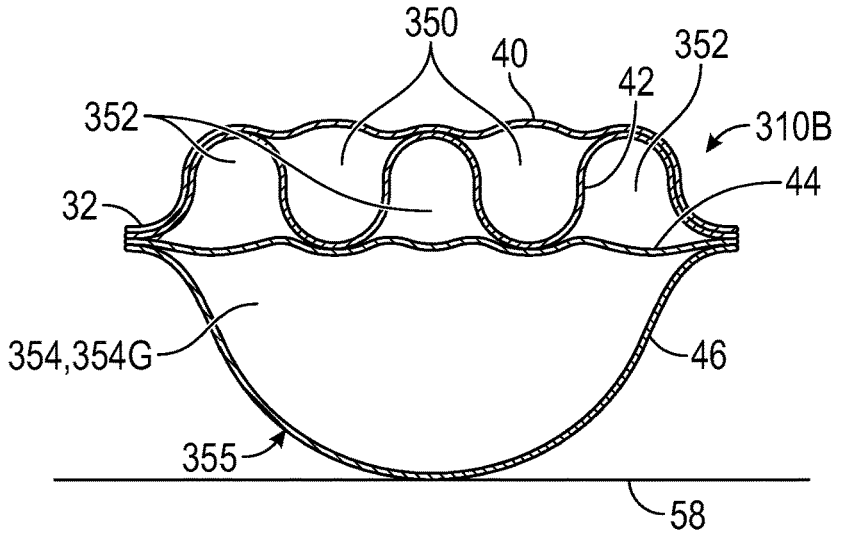
FIG. 19 is a cross-sectional view of a portion of the heel bladder of FIG. 16.
Figure 20:
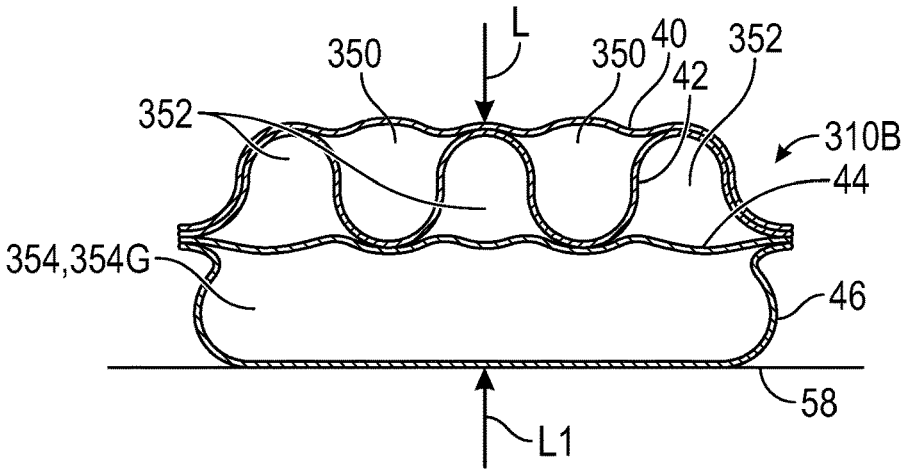
FIG. 20 is a cross-sectional view of the heel bladder of FIG. 19 in a first stage of compression.
Figure 21:
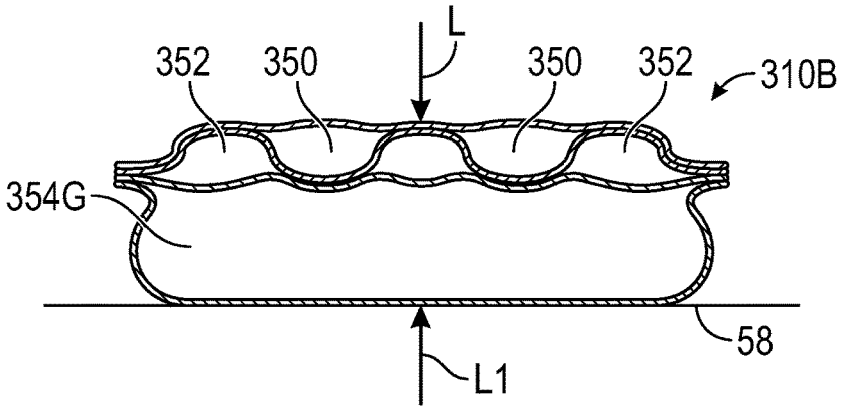
FIG. 21 is a cross-sectional view of the heel bladder of FIG. 19 in a second stage of compression.

FIG. 19 is a cross-sectional view of a portion of the heel bladder 310B of FIG. 16, taken through only one domed pod 354G of the third sealed chamber 354 for simplicity in describing the staged response. Domed pod 354G may be, for example, the rearmost domed pod shown in FIG. 16. FIG. 19 shows the heel bladder 310B in an unladed state. FIG. 20 shows the heel bladder 310B in a first stage of compression under a load L and showing a reaction load L1 of the ground plane 58. The first stage of compression is largely dominated by compression of the domed pod 354G. A plot of force (load L) versus displacement (e.g., vertical displacement of the bladder 10) would be linear, similar to the plot of FIG. 8, but possibly with a lower slope reflecting the large available vertical displacement and relatively low pressure of the domed pod 354G. FIG. 21 is a cross-sectional view of the heel bladder 310B of FIG. 19 in a second stage of compression under an increasing magnitude of load L. A plot of load versus displacement would show a nonlinear increase similar to portion 104 of the plot of FIG. 8, as the first sealed chamber 350 and then the relatively high pressure (and therefore stiff) second sealed chamber 352 begin compressing.

Referring again to FIG. 17, the sole structure 312 includes a heel outsole 336B that extends only along the ground-facing surface 355 (e.g., the lower domed surfaces) of the heel bladder 310B. Similarly, as shown in FIG. 18, the sole structure 312 includes a forefoot outsole 336A that extends only along the ground-facing surface 355 (e.g., the lower domed surfaces 355) of the forefoot bladder 310A. The outsoles 336A, 336B line and largely encapsulate the lower domed surfaces 355 of the domed pods of the third sealed chambers 354 of both bladders 310A, 310B, lending stability to the relatively high profile domed pods, such as in the transverse direction.

As is evident in FIGS. 16-18, the domed pods of the third sealed chamber 354 of the heel bladder 310B are taller than those of the forefoot bladder 310A. This both provides greater displacement for a softer absorption of a heel impact load, such as during a heel strike, and helps create the heel-to-toe drop in height of the article of footwear 314. To increase forefoot cushioning, a foam midsole layer 390 overlies only the forefoot bladder 310A (e.g., does not overlie the heel bladder 310B) and extends along the foot-facing surface 28 of the bladder 310A. As best shown in FIG. 18, the foam midsole layer 390 partially cups the outer perimeter of the bladder 310A, further assisting the forefoot outsole 336A in providing transverse stability (e.g., under lateral or side-to-side forces, such as during banking).

As shown in FIGS. 16-18, the support rim 337 is secured to the foot-facing surface 28 of the heel bladder 310B along an outer perimeter of the bladder 310B in the heel region 20 of the heel bladder 310B, and is also secured to the midsole layer 390 along an outer perimeter of the midsole layer 390 in the midfoot region 18 and the forefoot region 16 of the forefoot bladder 310A. The footwear upper 334 is secured to the support rim 337 and overlies the midsole layer 390 in the midfoot region 18 and in the forefoot region 16, and directly overlies the foot-facing surface 28 of the heel bladder 310B in the heel region 20.

Figure 22:
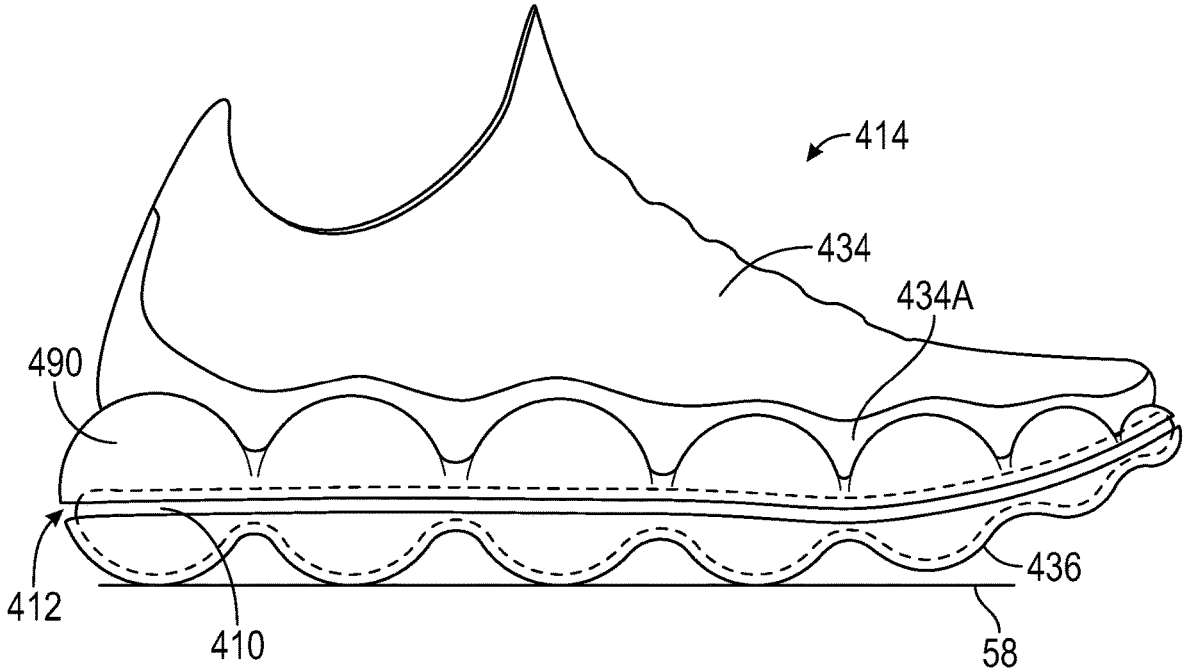
FIG. 22 is a lateral side view of another article of footwear having a sole structure including a full-length bladder.

FIG. 22 shows a lateral side view of another article of footwear 414 having a sole structure 412 including a full-length bladder 410. The bladder 410 is configured like bladders 310A and 310B but as a single bladder, including four stacked polymeric sheets having the bonds and sealed chambers as described with respect to bladders 310A, 310B, including the domed pods of the third sealed chamber. An outsole 436 lines and cups the lower domed surfaces of the bladder 410, similar to outsole 336A and outsole 336B. As the bladder 410 is full length, a foam midsole layer 490 overlies the entire foot-facing surface of the bladder 410. The foam midsole layer 490 is configured with domed portions that match the underlying domed lower surfaces of the pods of the third sealed chamber. Due to the relatively high-profile of the foam midsole layer 490, no support rim is included in the sole structure 412. A footwear upper 434 is coupled to the foam midsole layer 490. The footwear upper 434 may include a lower reinforcement 434A of a relatively stiff material to which the midsole layer 490 may be bonded.

Figure 23:
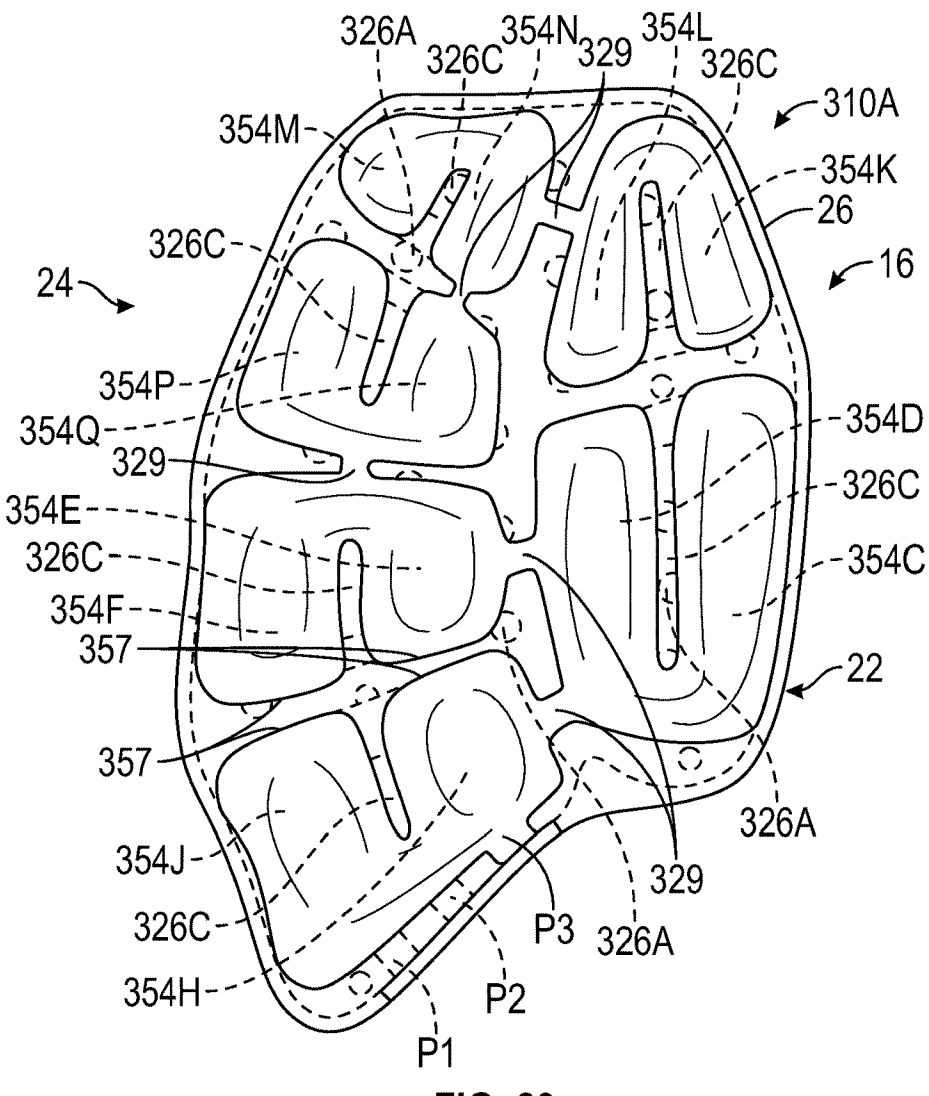
FIG. 23 is a bottom view of the forefoot bladder of FIG. 16.

FIG. 23 is a bottom view of the forefoot bladder 310A configured the same as described with respect to forefoot bladder 310A of FIGS. 16 and 18. As is apparent in the bottom view, adjacent domed pods of the third sealed chamber 354 are configured as lobes partially divided by one of the third bonds 326C. For example, adjacent domed pods 354E and 354F are lobes divided by a third bond 326C and have ends 357 extending toward ends 357 of lobes of an adjacent pair of domed pods 354H and 354J that are likewise partially divided by a third bond 326C. The same is true of adjacent domed pods 354C and 354D configured as lobes, adjacent domed pods 354K and 354L configured as lobes with ends extending toward ends of the lobes of domed pods 354C and 354D, adjacent domed pods 354M and 354N configured as lobes, and adjacent domed pods 354P and 354Q configured as lobes with ends extending toward ends of the lobes of the domed pods 354M and 354N. As shown in FIG. 23, only two of the domed pods 354C and 354K of the third sealed chamber 354 extend along the medial side 22 of the bladder in the forefoot region 16 and four of the domed pods 354M, 354P, 354F, and 354J extend along the lateral side 24 of the bladder 10 in the forefoot region 16.

Figure 25:
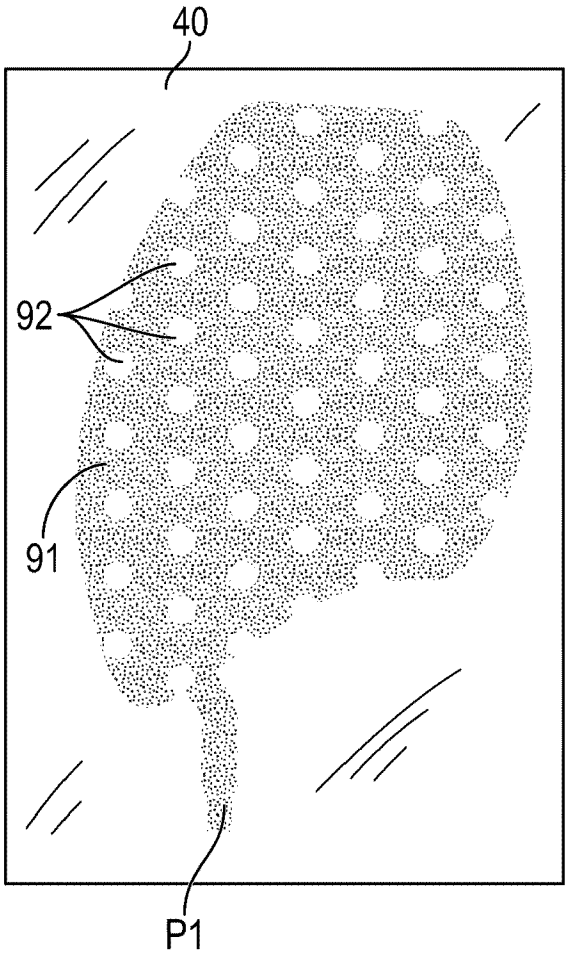
FIG. 25 is a plan view of a first polymeric sheet used in the forefoot bladder of FIG. 23 with a pattern of anti-weld material thereon.
Figure 26:
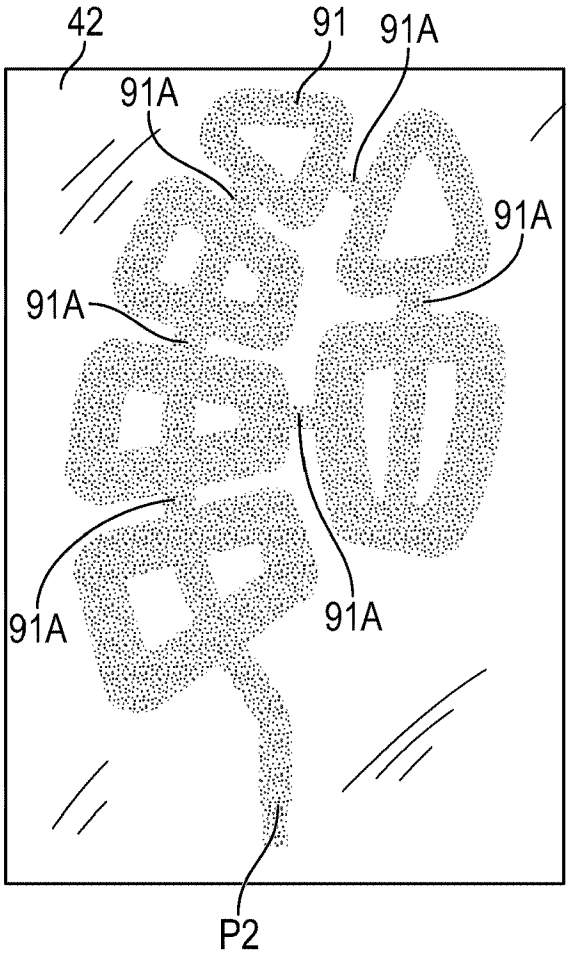
FIG. 26 is a plan view of a second polymeric sheet used in the forefoot bladder of FIG. 23 with a pattern of anti-weld material thereon.
Figure 27:
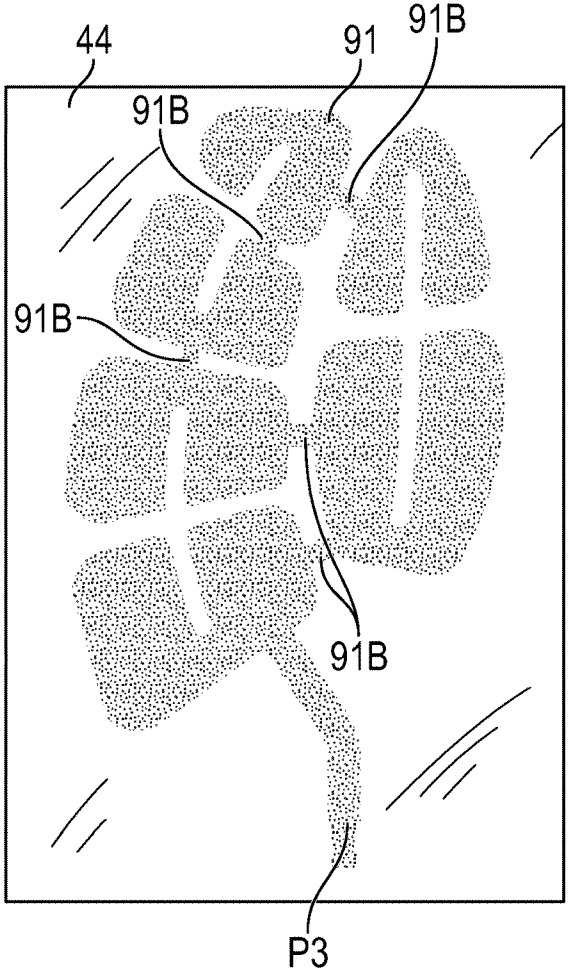
FIG. 27 is a plan view of a third polymeric sheet used in the forefoot bladder of FIG. 23 with a pattern of anti-weld material thereon.

FIGS. 25-27 show the bottom sides of the first polymeric sheet 40, the second polymeric sheet 42, and the third polymeric sheet 44, respectively, with a pattern of anti-weld ink printed on each sheet to result in the bonds of the forefoot bladder 310A. When heat pressed, adjacent sheets bond to one another everywhere except at the anti-weld ink patterns. For example, the pattern of anti-weld ink 91 on the bottom side of the first polymeric sheet 40 leaves a plurality of dots 92 not covered with the anti-weld ink 91. The areas of the sheet 40 at the dots 92 becomes the areas of the first dot bonds 326A. Only a single fill port P1 is needed to inflate the first sealed chamber 350 as indicated by the pattern.

Referring to FIG. 26, the pattern of anti-weld ink 91 on the bottom side of the second polymeric sheet 42 becomes the tubular frames of the second sealed chamber 352 established by the second bonds 326B. As can be seen in FIG. 25, all frame portions of the pattern are connected by links 91A that become channels connecting the tubular frames of the second sealed chamber 352, and enable a single fill port P2 to be used to inflate the entire second sealed chamber 352.

FIG. 27 shows that the pattern of anti-weld ink 91 that creates the twelve domed pods 354C-354Q described with respect to FIG. 23. Printed links 91B connecting the domed pods are at areas of the sheet 44 that become channels 329 permitting fluid communication between linked domed pods of the third sealed chamber 354 as indicated in FIG. 23. As such, only a single fill port P3 is needed to inflate the entire third sealed chamber 354 (e.g., all of the domed pods). Accordingly, the four domed pods 354M, 354P, 354F, and 354J extending along the lateral side 24, the two domed pods 354K and 354C extending along the medial side 22, and the other six domed pods 354D, 354L, 354N, 354Q, 354E, and 354H are all fluidly connected with one another and fillable via the single fill port P3 that extends from the domed pod 354H. The fill ports P1, P2, and P3 are sealed closed at the perimeter flange of the bladder 310A after inflation.

Figure 24:
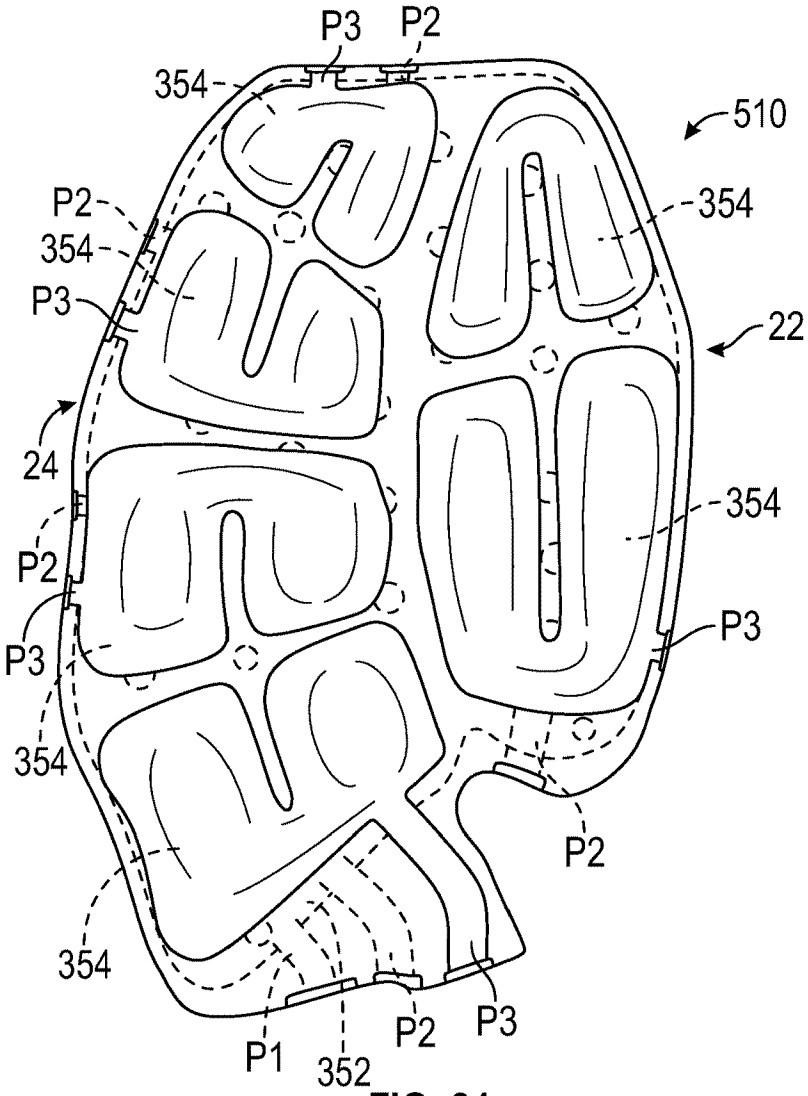
FIG. 24 is a bottom view of another forefoot bladder.
Figure 28:
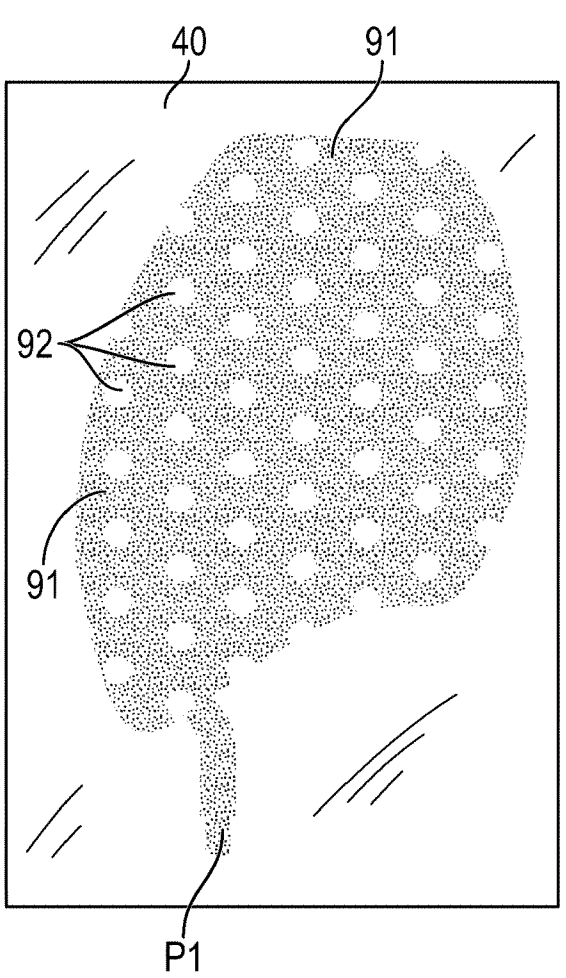
FIG. 28 is a plan view of a first polymeric sheet used in the forefoot bladder of FIG. 24 with a pattern of anti-weld material thereon.
Figure 29:
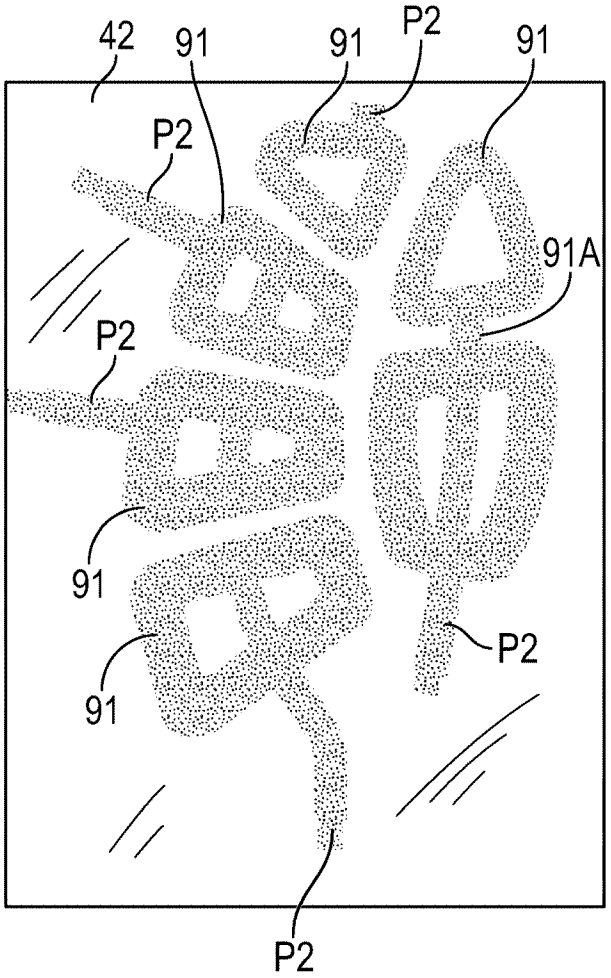
FIG. 29 is a plan view of a second polymeric sheet used in the forefoot bladder of FIG. 24 with a pattern of anti-weld material thereon.
Figure 30:
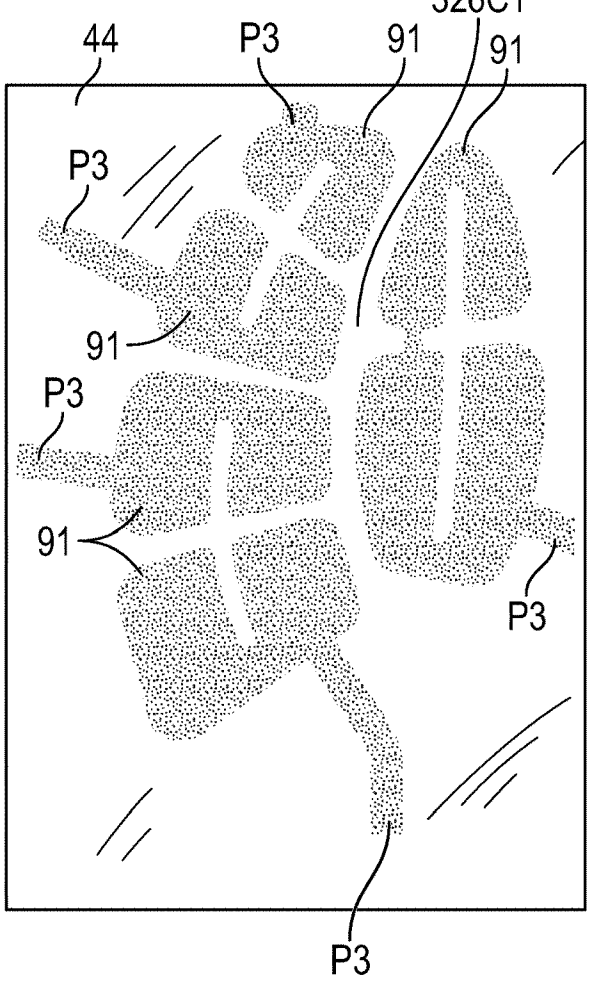
FIG. 30 is a plan view of a third polymeric sheet used in the forefoot bladder of FIG. 24 with a pattern of anti-weld material thereon.

FIG. 24 is a bottom view of a forefoot bladder 510 configured identically to the forefoot bladder 310A but with different patterns of anti-weld ink 91 used on the second polymeric sheet 42 and the third polymeric sheet 44, as shown in FIGS. 29 and 30, so that the tubular frames of the second sealed chamber (configured like second sealed chamber 352 of FIG. 17 and above the domed pods shown in FIG. 24) along the lateral side 24 are all isolated from one another, and the domed pods of the third sealed chamber 354 extending along the lateral side 24 are all isolated from one another. Accordingly, five fill ports P2 are needed to inflate the tubular frames of the second sealed chamber 352 and six fill ports P3 are needed to inflate the domed pods of the third sealed chamber 354. FIG. 28 shows that the same pattern of anti-weld ink 91 is used on the first polymeric sheet 40 as is used for the forefoot bladder 310A. As also shown in FIG. 30, one of the third bonds 326C (labeled as 326C1 for clarity) extends between and separates the pattern of anti-weld ink 91 for the domed pods extending along the medial side 22 from the pattern of anti-weld ink 91 for the domed pods extending along the lateral side 24. The separation of the medial side domed pods from the lateral side domed pods increases lateral flexibility of the bladder 510.

Figure 31:
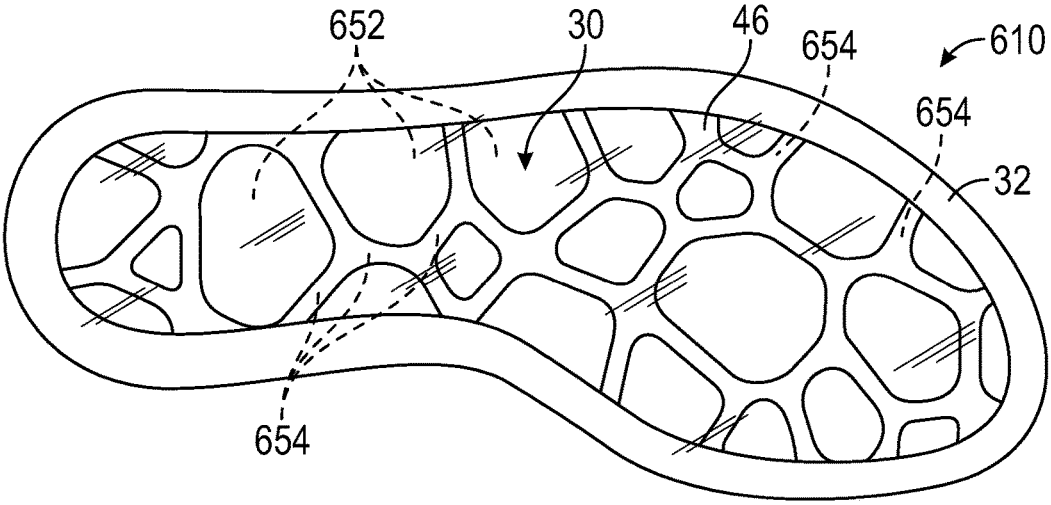
FIG. 31 is a bottom view of an alternative bladder.
Figure 32:
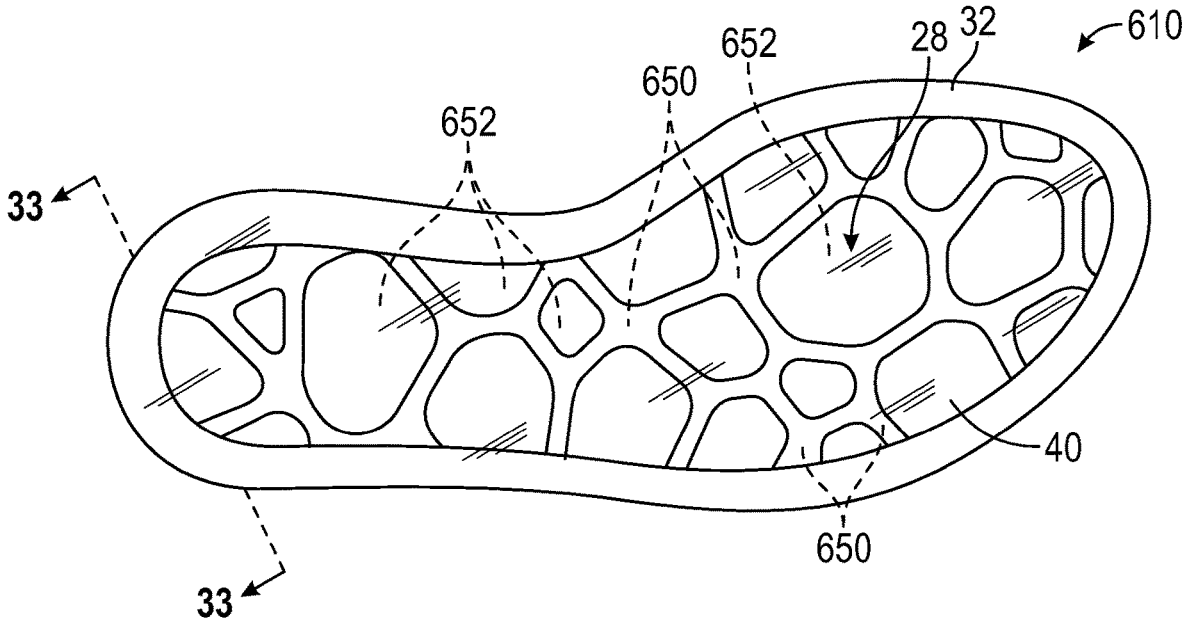
FIG. 32 is a top view of the bladder of FIG. 31.

FIG. 31 is a bottom view of an alternative bladder 610 configured from four stacked polymeric sheets bonded to one another at peripheral bonds creating a peripheral flange, and at additional sets of bonds as discussed herein. FIG. 31 shows the fourth polymeric sheet 46, which is the bottom sheet and defines the ground-facing surface 30. FIG. 32 is a top view of the bladder 610 of FIG. 31 and shows the top sheet, which is the first polymeric sheet 40 that defines the foot-facing surface 28. As can be seen by FIGS. 31-32, the bladder 610 is symmetrical at the top and bottom and includes a plurality of second sealed chambers 652 that directly underlie the foot-facing surface 28 of the bladder 610 and also directly overlie the ground-facing surface 30 of the bladder 610. Stated differently, no sealed chamber is between the second sealed chambers 652 and the foot-facing surface 28, and no sealed chamber is between the second sealed chambers 652 and the ground-facing surface 30. The second sealed chambers 652 are laterally surrounded by a first sealed chamber 650 that also underlies portions of the foot-facing surface 28, and by a third sealed chamber 654 that overlies portions the ground-facing surface 30 directly below the first sealed chamber 650. Only some of the second sealed chambers 652 and portions of the first and third sealed chambers 650, 654 are indicated with reference numbers in FIGS. 31 and 32.

Figure 33:
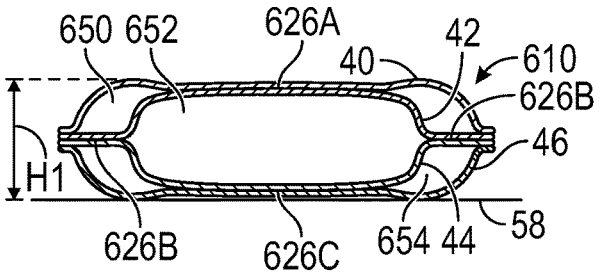
FIG. 33 is a cross-sectional view of the bladder of FIG. 32 taken at lines 33-33 in FIG. 32.
Figure 41:
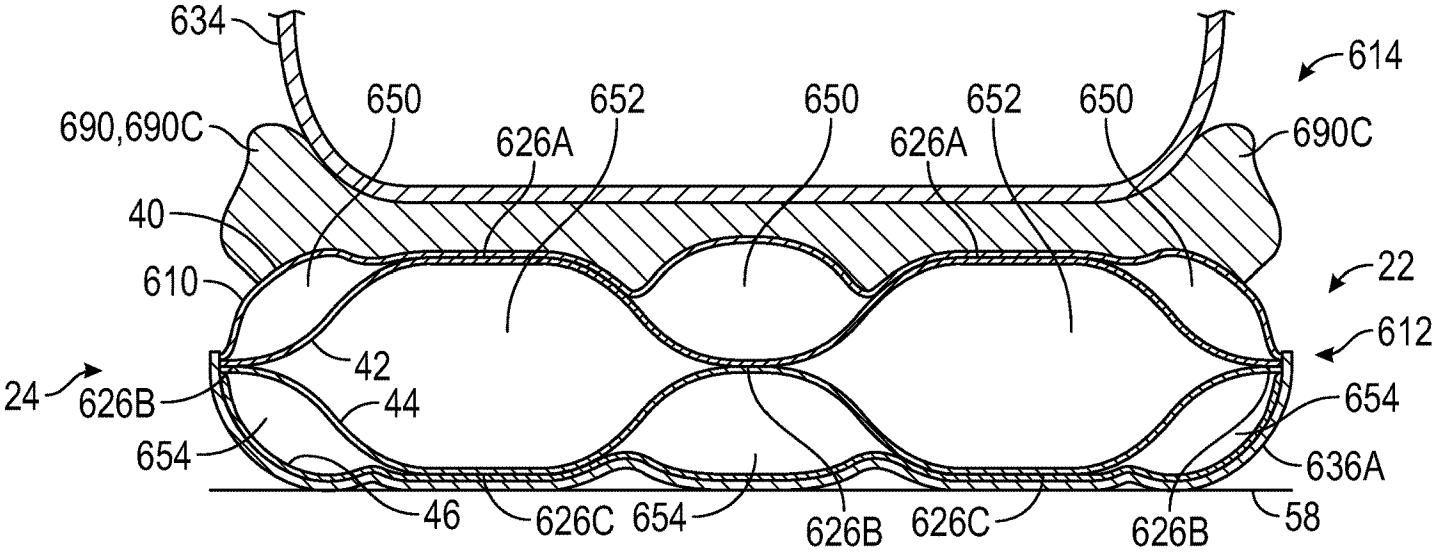
FIG. 41 is a cross-sectional view of the article of footwear of FIG. 39 taken at lines 41-41 in FIG. 39.
Figure 42:
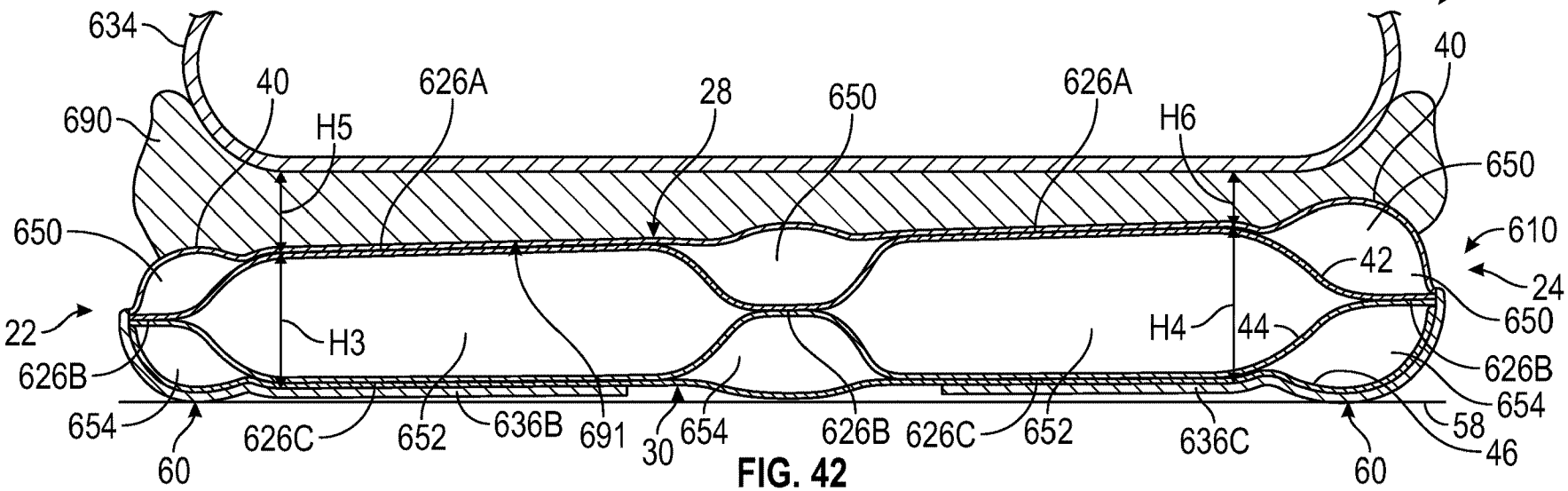
FIG. 42 is a cross-sectional view of the article of footwear of FIG. 39 taken at lines 42-42 in FIG. 39.

FIG. 33 is a cross-sectional view of the bladder of FIG. 32 taken at lines 33-33 in FIG. 32. FIG. 33 shows the four stacked polymeric sheets 40, 42, 44, and 46, including the first polymeric sheet 40 overlying the second polymeric sheet 42 and the first polymeric sheet 40 bonded to the second polymeric sheet 42 at a first bond 626A. FIGS. 41 and 42 provide additional cross-sectional views of the bladder 610 when assembled in a sole structure 612 of an article of footwear 614 shown in FIG. 39. As shown in FIGS. 41 and 42, there are actually a plurality of first bonds 626A spaced apart from one another, and the first polymeric sheet 40 and the second polymeric sheet 42 enclose a first sealed chamber 650 that transversely surrounds the plurality of first bonds 626A. The shape of the first sealed chamber 650 in an X-Y plane is best shown in FIGS. 31 and 32.

Referring again to FIG. 33, the second polymeric sheet 42 overlies the third polymeric sheet 44 and is bonded to the third polymeric sheet 44 at a plurality of second bonds 626B arranged in continuous closed shapes and offset from the plurality of first bonds 626A so that the second polymeric sheet 42 and the third polymeric sheet 44 enclose the plurality of second sealed chambers 652 (only one shown in FIG. 33) each surrounded by one of the continuous closed shapes of the second bonds 626B and directly underlying the foot-facing surface 28 of the bladder 610 and directly overlying the ground-facing surface 30. There is a thickness of two sheets (sheets 40 and 42) over the second sealed chambers 652, and a thickness of two sheets (sheets 44 and 46) under the second sealed chambers 652.

The third polymeric sheet 44 overlies the fourth polymeric sheet 46 and is bonded to the fourth polymeric sheet 46 at a third bond 626C. As shown in FIGS. 41 and 42, there are actually a plurality of third bonds 626C spaced apart from one another, and offset from the second bonds 626B and each underlying a respective one of the second sealed chambers 652 opposite a respective one of the first bonds 626A. The third polymeric sheet 44 and the fourth polymeric sheet 46 enclose a third sealed chamber 654 that surrounds the third bonds 626C and directly underlies the first sealed chamber 650. The first and third sealed chambers 650, 654 retain fluid in isolation from one another and from the second sealed chambers 652. As best shown in FIGS. 31 and 32, the first and third sealed chambers 650, 654 are a network of tubular air channels providing the structural framing for the array of nested cellular volumes of the second sealed chambers 652.

When the chambers 650, 652, and 654 are inflated, the double-thickness over the second sealed chambers 652 tensions the bladder 610 over the second sealed chambers 652 similar to a tightened drum surface over and under the second sealed chambers 652 at the foot-facing surface 28 and at the ground-facing surface 30, respectively. This tension helps to make the bladder 610 structurally stable, including under shear forces, and enables relatively planar foot-facing and ground-facing surfaces 28, 30. Additionally, as each second sealed chamber 652 can be fluidly isolated from all other chambers, the second sealed chambers 652 may have different inflation pressures, such as inflation pressures corresponding with different pressure zones of a foot pressure map, for example. Because the second sealed chambers 652 are reacted at both the foot-facing surface 28 and the ground-facing surface 30 (e.g., without another sealed chamber between the second sealed chambers 652 and those surfaces 28, 30), the cushioning response of the bladder 610 is quick and non-staging, dependent upon the height (and therefore available overall displacement) of the second sealed chambers 652, and the inflation pressure of the second sealed chambers 652 and the first and third sealed chambers 650, 654 against which the second sealed chambers 652 also react when under a compressive load. The pneumatics of the frame provided by the surrounding first and third sealed chambers 650, 654 is decoupled from the pneumatics affecting the surface tension over the second sealed chambers 652. Stated differently, each is dependent largely only upon the inflation pressure of the respective chamber.

The drum-like surface tension is utilized to constrain the inflation pressure within each second sealed chamber 652 and amplify its effect, resulting in a response that can be quick, similar to a trampoline. Each second sealed chamber 652 can be calibrated in size, pressure, and fluid communication (or lack thereof) between other second sealed chambers 652 to create a mapped load response. This mapping can be utilized to create specific gradations of pressure to enable functions such as banking (e.g., establish greater pressures at second sealed chambers 652 nearer to a lateral side 24 or a medial side 22 of the bladder 610 than at second sealed chambers nearer to the center) and/or transition dynamics (e.g., heel to toe transition with fluid displacement as discussed above). The configuration of the bladder 610 stages in compression in the Z direction across the x,y plane (e.g., toward the ground plane 58), with only one stage at each cell (e.g., at each second sealed chamber 652).

Figure 34:
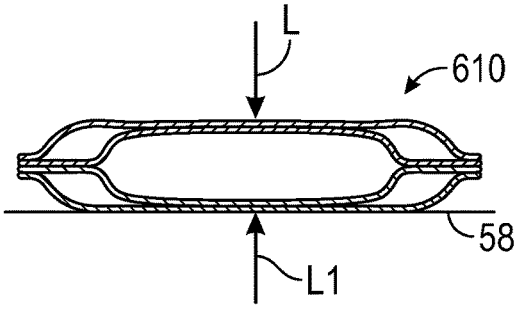
FIG. 34 is a cross-sectional view showing the bladder of FIG. 33 under compression.
Figure 35:
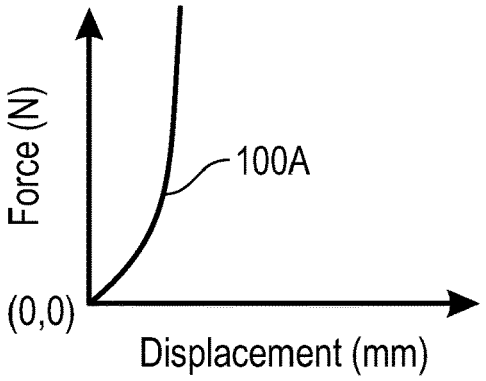
FIG. 35 is a plot of force versus displacement during compression of the bladder of FIGS. 33-34.
Figure 36:
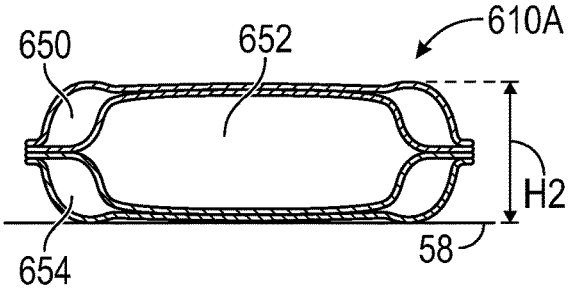
FIG. 36 is a cross-sectional view of a bladder like that of FIG. 32 configured to be of a greater height.
Figure 37:
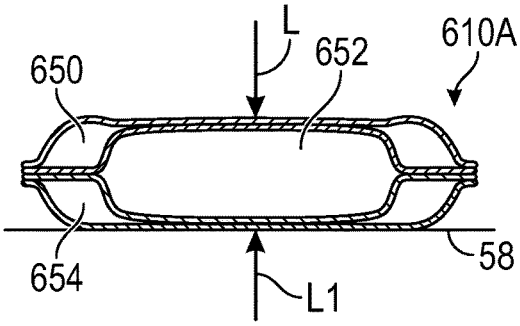
FIG. 37 is a cross-sectional view showing the bladder of FIG. 36 under compression.
Figure 38:
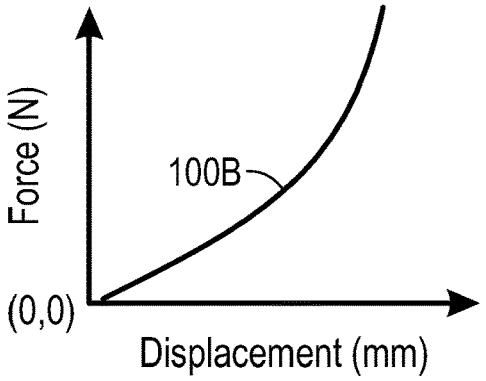
FIG. 38 is a plot of force versus displacement during compression of the bladder of FIGS. 36-37.

The proportions of the second sealed chambers 652 (height to width) in conjunction with their inflation pressure(s) has a considerable effect on ride characteristics. For example, FIG. 33 shows the bladder 610 in an unloaded state, and FIG. 34 shows the bladder 610 under a compressive load L with a reaction load L1 of the ground plane 58 against the bladder 610. FIG. 35 is a plot of force versus displacement during compression of the bladder of FIGS. 33-34. The load versus displacement curve 100A represents an immediate nonlinear increase in stiffness of the bladder 610 with increasing load (e.g., a single stage). FIG. 36 shows a bladder 610A in an unloaded state. The bladder 610A has the same construction as bladder 610 except that the bonds are sized so that the height H2 of the bladder 610A (such as at its second sealed chambers 652 (one shown)) is greater than the height H1 of the bladder 610 such as at its second sealed chambers 652, with the heights H1, H2 measured when the bladder 610 is in an unloaded state. FIG. 38 shows a plot 100B of force versus displacement during compression of the bladder 610A (shown compressed in FIG. 37). The taller height provides a greater displacement (deflection in the Z direction) under a given load, causing a more gradually increasing nonlinear stiffness than the bladder 610.

Figure 39:
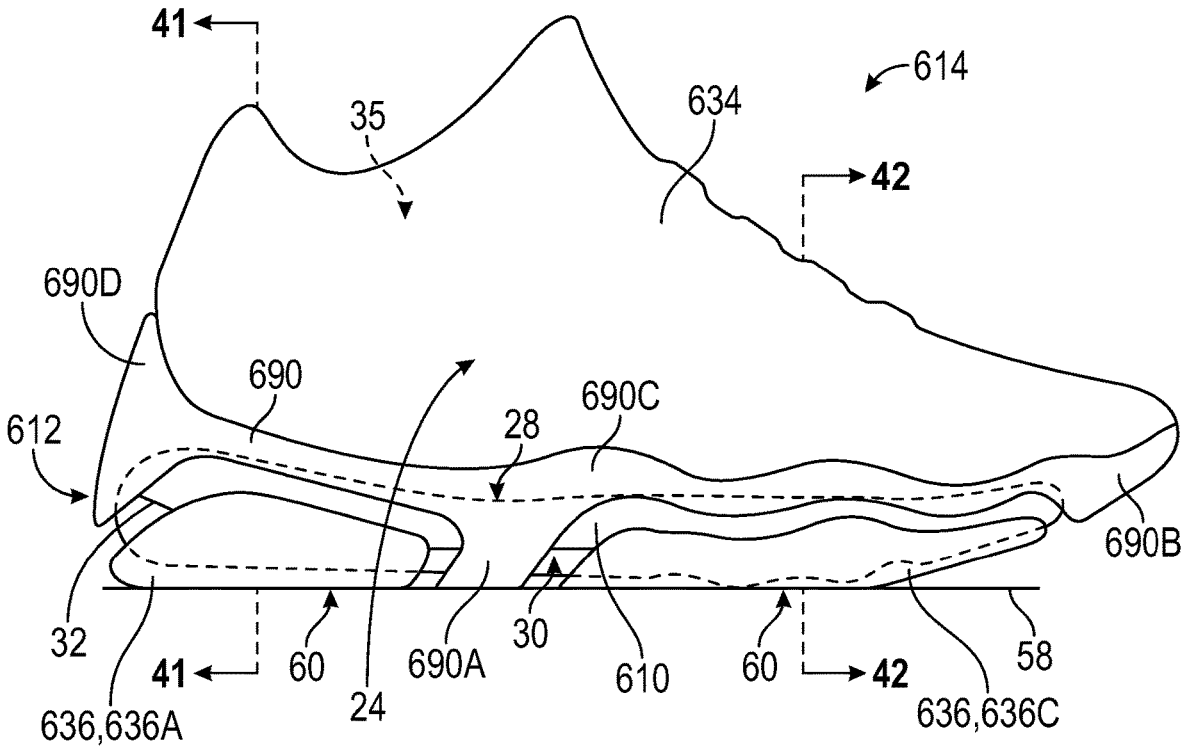
FIG. 39 is a lateral side view of an article of footwear having a sole structure including the bladder of FIG. 31.

FIG. 39 is a lateral side view of the article of footwear 614 having a sole structure 612 including the bladder 610 of FIG. 31. The sole structure 612 includes an overlying foam midsole layer 690 that overlies the entire foot-facing surface 28 of the bladder 610 and couples to the footwear upper 634. As shown in FIG. 39, a portion of the exterior peripheral surface of the bladder 610 is exposed under the foam midsole layer 690.

Figure 40:
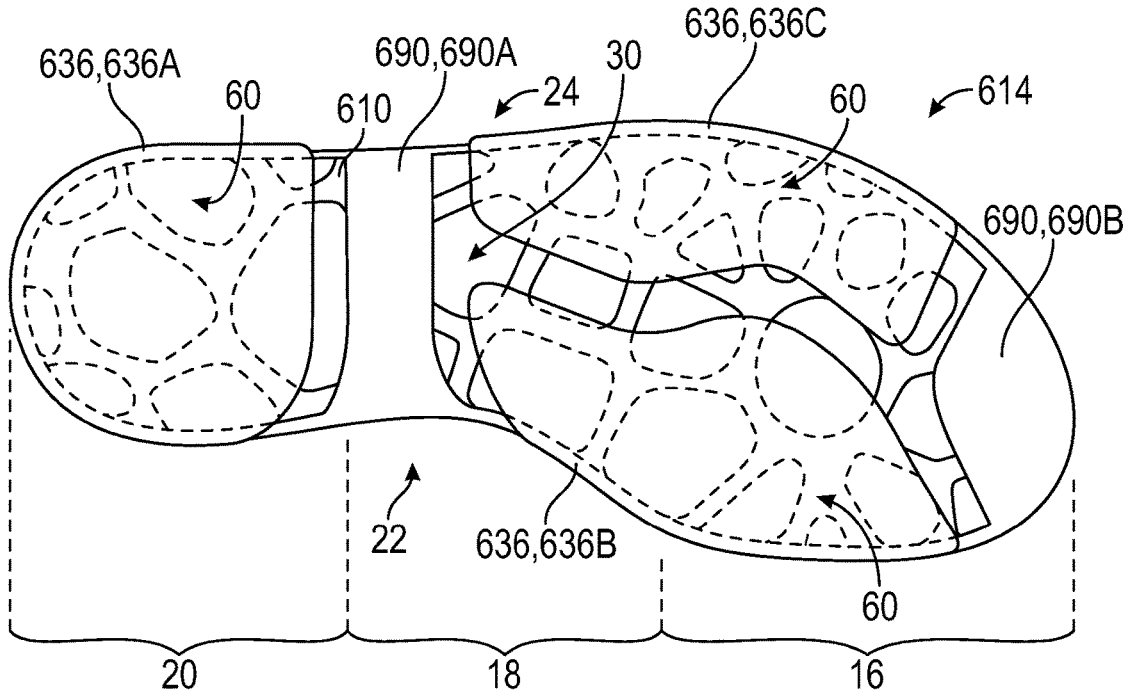
FIG. 40 is a bottom view of the article of footwear of FIG. 39.

FIG. 40 is a bottom view of the article of footwear 614 of FIG. 39. As shown, the foam midsole layer 690 wraps around an exterior peripheral surface of the bladder 610 (e.g., the periphery of the bladder 610) at the medial side 22 and at the lateral side 24 and extends across the ground-facing surface 30 under the bladder 610 in a midfoot region 18 of the bladder 610. This portion of the foam midsole layer 690 may be referred to as a midfoot wrap 690A. The foam midsole layer 690 also includes a portion that wraps around the front of and under onto the ground-facing surface 30 of the bladder 610 in the forefoot region 16. This portion of the foam midsole layer 690 may be referred to as a toe wrap 690B. Referring back to FIG. 39, the foam midsole layer 690 extends upward along the medial side (not shown) and the lateral side 24 of the footwear upper 634, establishing a sidewall portion 690C of the foam midsole layer 690, and along the rear of the footwear upper 634 in the heel region 20, establishing a heel counter portion 690D of the foam midsole layer 690.

The sole structure 612 has a multi-piece outsole 636 including a heel outsole component 636A, a first outsole component 636B extending along the medial side 22 of the bladder at the ground-facing surface 30, and a second outsole component 636C extending along the lateral side 24 of the bladder 610 at the ground-facing surface 30. The outsole components 636A, 636B, and 636C establish a ground-engaging surface 60 of the sole structure 612 that engages the ground plane 58. Referring to FIGS. 41 and 42, the heel outsole component 636A as well as the first and second outsole components 636B, 636C are bonded to and cup the ground-facing surface 30 of the bladder 610, even extending upward and bonded to an exterior peripheral surface of the bladder 610 above the peripheral flange 32, but remain below and are not coupled to the midsole layer 690 or the footwear upper 634, so that the outsole components 636A, 636B, and 636C are decoupled from the midsole layer 690 and "float" with the bladder 610. This configuration of the outsole components 636A, 636B, and 636C enables the outsole components 636A, 636B, and 636C to support the bladder 610 without constraining the pneumatics of the second sealed chambers 652 or the first sealed chambers 650 under compression. Similar to the suspended bladder 10 of FIG. 4, the bladder 610 may be slightly suspended between the first outsole component 636B and the second outsole component 636C at the ground-facing surface 30 and entirely above the ground-engaging surface 60 of the first and second outsole components 636B, 636C, as shown in FIG. 42. This decoupling of the outsole components 636B, 636C enable the bladder 610 to compress under a banking load without excessive restraint from and potentially with reduced shear forces on the outsole components 636B, 636C.

As best shown in FIG. 42, the bladder 610 increases in height from the medial side 22 to the lateral side 24 in the forefoot region 16 of the bladder 610. For example, the bladder 610 has a height H3 near the medial side 22 that is less than a height H4 near the lateral side 24. Conversely, the foam midsole layer 690 decreases in height from the medial side 22 to the lateral side 24 of the bladder 610 in the forefoot region 16 of the bladder 610, as best shown by the height H5 near the medial side 22 being greater than the height H6 near the lateral side 24. The changes in height of the bladder 610 and the foam midsole layer 690 are not absolute, as there may be some exceptions to the relative heights between the lateral side 24 and the medial side 22 (such as at the stacked first and third sealed chambers 650, 654 shown in the center of FIG. 42). Instead, the relative heights are representative of a general, overall increase or decrease. With these height gradients, the interface of the foot-facing surface 28 of the bladder 610 and a bottom surface 691 of the midsole layer 690 is slightly angled relative to a ground plane 58 (similar to the surface 72 of the wedge component 39 of FIGS. 10-11) so that a reaction force of the bladder 610 at the foot-facing surface 28 against an overlying foot (e.g., a force normal to the relatively planar foot-facing surface 72) is at an angle to vertical and has a component extending from the lateral side 24 toward the medial side 22, the bladder 610 thereby reacting lateral forces (e.g., forces directed from the medial side 22 toward the lateral side 24), such as to react a side-to-side or "banking" movement.

Figure 43:
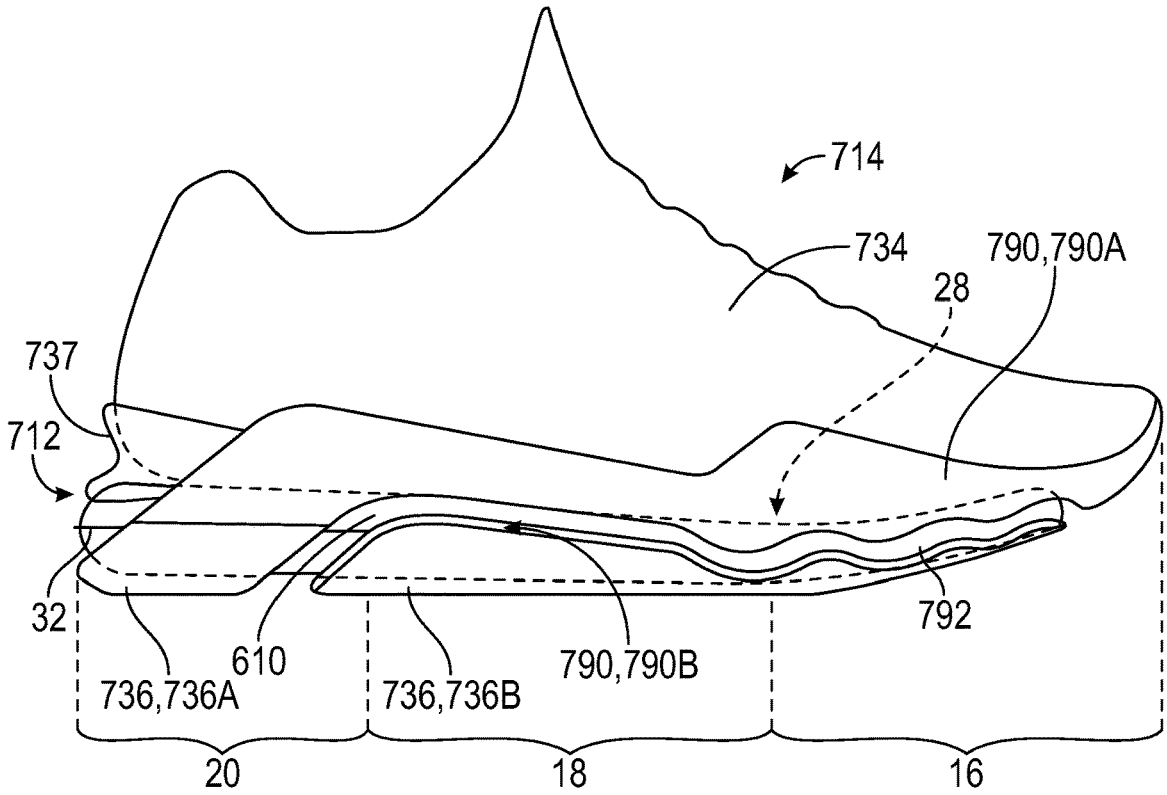
FIG. 43 is a lateral side view of an alternative article of footwear having a sole structure including the bladder of FIG. 31.

FIG. 43 is a lateral side view of an alternative article of footwear 714 having a sole structure 712 including the bladder 610 of FIG. 31. The sole structure 712 includes a support rim 737 similar to support rim 37 but extending only in the heel region 20. A foam midsole layer 790 extends over the foot-facing surface 28 of the bladder 610, up the sides of the footwear upper 734, and below the bladder 610, with a split 792 between an upper portion 790A and a lower portion 790B of the midsole layer 790 so that the midsole layer 790 does not overly constrain the pneumatics of the bladder 610.

An outsole 736 includes first and second outsole components 736A, 736B underlying the bladder 610 and the midsole layer 790. The first and second outsole components 736A, 736B are decoupled from one another also by the split 792 so as not to constrain the pneumatics of the bladder 610.

Figure 44:
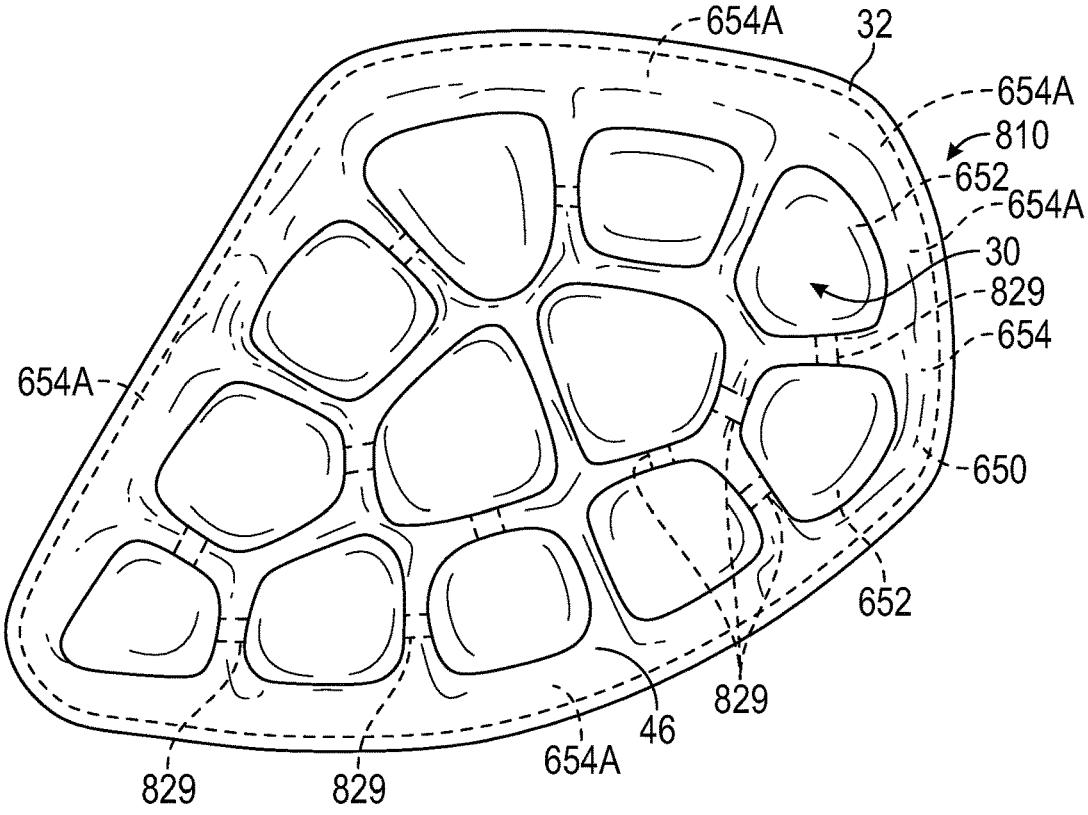
FIG. 44 is a bottom view of an alternative forefoot bladder.

FIG. 44 is a bottom view of an alternative forefoot bladder 810 that includes the four stacked polymeric sheets 40, 42, 44, and 46 (only the bottom, fourth polymeric sheet 46 shown in FIG. 44) and has first, second, and third sealed chambers 650, 652, 654 described as with respect to bladder 610. As is evident by the tubular frame of the third sealed chamber 654 disposed at the ground-facing surface 30 (and the first sealed chamber 650 disposed below the third sealed chamber 654 and a mirror image thereof), both the first sealed chamber 650 and the third sealed chamber 654 define an entire outer ring of the bladder 610 inward of the peripheral flange 32. The outer ring is indicated by the portions of the third sealed chamber 654 labelled as 654A. Stated differently, the stacked first sealed chamber 650 and third sealed chamber 654 entirely surround and are positioned between all of the second sealed chambers 652 and the peripheral flange 32. Channels 829 (only some of which are labelled) interconnect the various second sealed chambers 652 so that the drum-like second sealed chambers 652 are in fluid communication with one another.

The following Clauses provide example configurations of an article of footwear disclosed herein.

Clause 1. An article of footwear comprising: a sole structure including a bladder having stacked polymeric sheets including a first polymeric sheet, a second polymeric sheet, a third polymeric sheet, and a fourth polymeric sheet, the first polymeric sheet overlying the second polymeric sheet, the second polymeric sheet overlying the third polymeric sheet, and the third polymeric sheet overlying the fourth polymeric sheet; wherein peripheries of the stacked polymeric sheets are bonded to one another at a peripheral bond to define a peripheral flange; wherein adjacent ones of the stacked polymeric sheets are bonded to one another at sets of offset dot bonds to define a first sealed chamber between the first and second polymeric sheets, a second sealed chamber between the second and third polymeric sheets, and a third sealed chamber between the third and fourth polymeric sheets, each of the first, second, and third sealed chambers retaining fluid in isolation from one another; the sole structure further including a first outsole component extending along a medial side of the bladder at an exterior ground-facing surface of the bladder and partially establishing a ground-engaging surface of the sole structure, and a second outsole component extending along a lateral side of the bladder at the exterior ground-facing surface and further defining the ground-engaging surface of the sole structure; and wherein the bladder is suspended between the first outsole component and the second outsole component at the exterior ground-facing surface entirely above the ground-engaging surface.

Clause 2. The article of footwear of clause 1, wherein the offset dot bonds include: first dot bonds arranged in rows and at which the first polymeric sheet is bonded to the second polymeric sheet; second dot bonds arranged in rows offset from the rows of the first dot bonds and at which the second polymeric sheet is bonded to the third polymeric sheet; and third dot bonds arranged in rows vertically aligned with the rows of the first dot bonds and at which the third polymeric sheet is bonded to the fourth polymeric sheet.

Clause 3. The article of footwear of any of clauses 1-2, wherein: the sole structure further includes a wedge component secured to the exterior ground-facing surface of the bladder between the first outsole component and the second outsole component; the wedge component increases in thickness in a direction from a medial side of the bladder toward a lateral side of the bladder such that a ground-facing surface of the wedge component is non-parallel with a ground plane on which the sole structure rests and is entirely above the ground-engaging surface of the sole structure when the sole structure is in an unloaded state.

Clause 4. The article of footwear of any of clauses 1-3, wherein the first polymeric sheet defines a foot-facing surface of the bladder, and the article of footwear further comprising: a support rim secured to the foot-facing surface of the bladder along an outer perimeter of the bladder; and a footwear upper; wherein an exterior flange of the support rim extends upward along and is secured to an outer surface of the footwear upper and an interior flange of the support rim extends inward between and is secured to the footwear upper and the bladder.

Clause 5. The article of footwear of any of clauses 1-4, further comprising: a foam midsole layer secured to the bladder and disposed below the bladder and above the first outsole component and the second outsole component; a footwear upper overlying the bladder; and wherein the foam midsole layer extends upward along an outer surface of the footwear upper.

Clause 6. An article of footwear comprising: a sole structure including a bladder having stacked polymeric sheets including a first polymeric sheet, a second polymeric sheet, a third polymeric sheet, and a fourth polymeric sheet, the first polymeric sheet overlying the second polymeric sheet, the second polymeric sheet overlying the third polymeric sheet, and the third polymeric sheet overlying the fourth polymeric sheet; wherein peripheries of the stacked polymeric sheets are bonded to one another at a peripheral bond to define a peripheral flange; wherein the first polymeric sheet is bonded to the second polymeric sheet at a plurality of first dot bonds spaced apart from one another and arranged in offset rows, the first polymeric sheet and the second polymeric sheet enclosing a first sealed chamber that surrounds the first dot bonds; wherein the second polymeric sheet is bonded to the third polymeric sheet at a plurality of second dot bonds so that the second polymeric sheet and the third polymer sheet define a second sealed chamber configured as one or more tubular frames; and wherein the third polymeric sheet is bonded to the fourth polymeric sheet at a plurality of third bonds so that the third polymeric sheet and the fourth polymeric sheet define a third sealed chamber configured as domed pods protruding at the fourth polymeric sheet, each of the domed pods underlying a respective one of the tubular frames of the second sealed chamber, and adjacent domed pods configured as lobes partially divided by one of the third bonds, and each of the first, second, and third sealed chambers retaining fluid in isolation from one another.

Clause 7. The article of footwear of clause 6, wherein multiple ones of the first dot bonds are disposed above a single one of the domed pods.

Clause 8. The article of footwear of any of clauses 6-7, wherein the domed pods are arranged with ends of the lobes of a pair of the adjacent domed pods extending toward ends of the lobes of another pair of the adjacent domed pods.

Clause 9. The article of footwear of clause 6, wherein: the bladder includes a forefoot region in which only two of the domed pods extend along a medial side of the bladder and only four of the domed pods extend along a lateral side of the bladder; and one of the third bonds extends between and separates the domed pods extending along the medial side of the bladder from the domed pods extending along the lateral side of the bladder.

Clause 10. The article of footwear of clause 9, wherein the domed pods extending along the lateral side of the bladder are each fluidly isolated from one another.

Clause 11. The article of footwear of clause 9, wherein the bladder defines a fill port, and the domed pods extending along the lateral side of the bladder and the domed pods extending along the medial side of the bladder are all fluidly connected with one another and fillable via the fill port.

Clause 12. The article of footwear of any of clauses 6-11, further comprising an outsole extending along a ground-facing surface of the bladder.

Clause 13. The article of footwear of any of clauses 6-11, further comprising a foam midsole layer overlying the bladder and extending along a foot-facing surface of the bladder.

Clause 14. The article of footwear of clause 13, wherein the foam midsole layer overlies only a forefoot region and a midfoot region of the bladder, and the article of footwear further comprising: a support rim secured to the foot-facing surface of the bladder along an outer perimeter of the bladder in a heel region of the bladder and secured to the foam midsole layer along an outer perimeter of the foam midsole layer in the midfoot region and the forefoot region; and a footwear upper secured to the support rim and overlying the foam midsole layer in the midfoot region and the forefoot region, and overlying the foot-facing surface of the bladder in the heel region.

Clause 15. An article of footwear comprising: a sole structure including a bladder having stacked polymeric sheets including a first polymeric sheet, a second polymeric sheet, a third polymeric sheet, and a fourth polymeric sheet, the first polymeric sheet overlying the second polymeric sheet, the second polymeric sheet overlying the third polymeric sheet, and the third polymeric sheet overlying the fourth polymeric sheet; wherein peripheries of the stacked polymeric sheets are bonded to one another at a peripheral bond to define a peripheral flange; wherein the first polymeric sheet is bonded to the second polymeric sheet at a plurality of first bonds spaced apart from one another, the first polymeric sheet and the second polymeric sheet enclosing a first sealed chamber that surrounds the plurality of first bonds; wherein the second polymeric sheet is bonded to the third polymeric sheet at a plurality of second bonds arranged in continuous closed shapes and offset from the plurality of first bonds so that the second polymeric sheet and the third polymeric sheet enclose a plurality of second sealed chambers each surrounded by one of the continuous closed shapes and directly underlying a foot-facing surface of the bladder and directly overlying a ground-facing surface of the bladder; wherein the third polymeric sheet is bonded to the fourth polymeric sheet at a plurality of third bonds spaced apart from one another and offset from the second bonds and each underlying a respective one of the second sealed chambers opposite a respective one of the first bonds, the third polymeric sheet and the fourth polymeric sheet enclosing a third sealed chamber that surrounds the third bonds and directly underlies the first sealed chamber; and wherein the first sealed chamber and the third sealed chamber retain fluid in isolation from one another and from the second sealed chambers.

Clause 16. The article of footwear of clause 15, wherein the first sealed chamber and the third sealed chamber define an entire outer ring of the bladder inward of the peripheral flange.

Clause 17. The article of footwear of any of clauses 15-16, wherein the first polymeric sheet defines a foot-facing surface of the bladder; and the sole structure further includes a first outsole component extending along a medial side of the bladder at the ground-facing surface of the bladder and a second outsole component extending along a lateral side of the bladder at the ground-facing surface of the bladder, the first and second outsole components establishing a ground-engaging surface of the sole structure.

Clause 18. The article of footwear of clause 17, wherein the first outsole component and the second outsole component are bonded to an exterior peripheral surface of the bladder, and the article of footwear further comprising: a foam midsole layer overlying the bladder; wherein a portion of the exterior peripheral surface is exposed under the foam midsole layer.

Clause 19. The article of footwear of clause 18, wherein the midsole layer wraps around the exterior peripheral surface of the bladder at the medial side and at the lateral side and extends under the bladder and across the ground-facing surface of the bladder in a midfoot region of the bladder.

Clause 20. The article of footwear of clause 15, further comprising: a foam midsole layer overlying the bladder; wherein the bladder increases in height from a medial side of the bladder to a lateral side of the bladder in a forefoot region of the bladder; and wherein the midsole layer decreases in height from the medial side of the bladder to the lateral side of the bladder in the forefoot region of the bladder.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending along a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending along a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure including a bladder having stacked polymeric sheets including a first polymeric sheet, a second polymeric sheet, a third polymeric sheet, and a fourth polymeric sheet, the first polymeric sheet overlying the second polymeric sheet, the second polymeric sheet overlying the third polymeric sheet, and the third polymeric sheet overlying the fourth polymeric sheet;

wherein peripheries of the stacked polymeric sheets are bonded to one another at a peripheral bond to define a peripheral flange;

wherein the first polymeric sheet is bonded to the second polymeric sheet at a plurality of first dot bonds spaced apart from one another and arranged in offset rows, the first polymeric sheet and the second polymeric sheet enclosing a first sealed chamber that surrounds the first dot bonds;

wherein the second polymeric sheet is bonded to the third polymeric sheet at a plurality of second bonds so that the second polymeric sheet and the third polymer sheet define a second sealed chamber configured as one or more tubular frames; and wherein the third polymeric sheet is bonded to the fourth polymeric sheet at a plurality of third bonds so that the third polymeric sheet and the fourth polymeric sheet define a third sealed chamber configured as domed pods protruding at the fourth polymeric sheet;

wherein each of the third bonds directly underlies a respective one of the second bonds such that three of the stacked polymeric sheets are stacked in contact with one another at the third bonds;

wherein each of the domed pods underlies a respective one of the tubular frames of the second sealed chamber, and adjacent domed pods are configured as lobes partially divided by one of the third bonds, and each of the first, second, and third sealed chambers retain fluid in isolation from one another.

2. The article of footwear of claim 1, wherein multiple ones of the first dot bonds are disposed above a single one of the domed pods.

3. The article of footwear of claim 1, wherein the domed pods are arranged with ends of the lobes of a pair of the adjacent domed pods extending toward ends of the lobes of another pair of the adjacent domed pods.

4. The article of footwear of claim 1, further comprising:

an outsole extending along a ground-facing surface of the bladder.

5. The article of footwear of claim 4, wherein the outsole lines and cups the domed pods and extends only along lower domed surfaces of the domed pods.

6. The article of footwear of claim 1, further comprising:

a foam midsole layer overlying the bladder and extending along a foot-facing surface of the bladder.

7. The article of footwear of claim 6, wherein the foam midsole layer overlies only a forefoot region and a midfoot region of the bladder.

8. The article of footwear of claim 7, further comprising:

a support rim secured to the foot-facing surface of the bladder along an outer perimeter of the bladder in a heel region of the bladder and secured to the foam midsole layer along an outer perimeter of the foam midsole layer in the midfoot region and the forefoot region.

9. The article of footwear of claim 8, further comprising:

a footwear upper secured to the support rim, overlying the foam midsole layer in the midfoot region and the forefoot region, and overlying the foot-facing surface of the bladder in the heel region.

10. The article of footwear of claim 1, further comprising:

a footwear upper; and a support rim secured to a foot-facing surface of the bladder along an outer perimeter of the bladder;

wherein the support rim includes an upper exterior flange, a lower exterior flange, and an interior flange; and wherein the upper exterior flange extends upward along and is secured to an outer surface of the footwear upper, the interior flange extends inward between and is secured to both the footwear upper and the foot-facing surface of the bladder, and the lower exterior flange extends downward and is secured along an outer perimeter of the bladder below the footwear upper.

11. The article of footwear of claim 1, wherein the bladder is a forefoot bladder, and the article of footwear further comprises:

a heel bladder fluidly isolated from the forefoot bladder.

12. The article of footwear of claim 11, wherein the heel bladder comprises:

four stacked polymeric sheets bonded to one another at another peripheral bond to define another peripheral flange separate from the peripheral flange of the forefoot bladder;

wherein first and second polymeric sheets of the four stacked polymeric sheets of the heel bladder are bonded to one another at another plurality of first dot bonds spaced apart from one another and arranged in offset rows, the first and second polymeric sheets of the four stacked polymeric sheets of the heel bladder enclosing another first sealed chamber that surrounds the another plurality of first dot bonds;

wherein the second polymeric sheet of the four stacked polymeric sheets of the heel bladder is bonded to a third polymeric sheet of the four stacked polymeric sheets of the heel bladder at another plurality of second bonds so that the second and third polymer sheets of the four stacked polymeric sheets of the heel bladder define another second sealed chamber configured as one or more tubular frames; and wherein the third polymeric sheet of the four stacked polymeric sheets of the heel bladder is bonded to a fourth polymeric sheet of the four stacked polymeric sheets of the heel bladder at another plurality of third bonds so that the third polymeric and fourth polymeric sheets of the four stacked polymeric sheets of the heel bladder define another third sealed chamber configured as domed pods protruding at the fourth polymeric sheet of the four stacked polymeric sheets of the heel bladder.

13. The article of footwear of claim 1, wherein the bladder defines a fill port, and the domed pods extending along a lateral side of the bladder and the domed pods extending along a medial side of the bladder are all fluidly connected with one another and fillable via the fill port.

14. The article of footwear of claim 1, wherein all of the second sealed chamber is in series with the first sealed chamber and/or the third sealed chamber.

15. The article of footwear of claim 1, wherein only the first sealed chamber and the second sealed chamber define a foot-facing surface of the bladder.

16. The article of footwear of claim 1, wherein only the first sealed chamber and the third sealed chamber define a ground-facing surface of the bladder.

17. The article of footwear of claim 1, wherein the first sealed chamber defines a portion of a foot-facing surface of the bladder and a portion of a ground-facing surface of the bladder.

* * * * *